US011019943B2

(12) United States Patent
Burgert et al.

(10) Patent No.: US 11,019,943 B2
(45) Date of Patent: Jun. 1, 2021

(54) FULL WING DISPLAY

(71) Applicant: Menasha Corporation, Neenah, WI (US)

(72) Inventors: Gina L. Burgert, Neenah, WI (US); Amy Melnick, Northbrook, IL (US); Colleen Wills, New Lenox, IL (US)

(73) Assignee: Menasha Corporation, Neenah, WI (US)

( * ) Notice: Subject to any disclaimer, the term of this patent is extended or adjusted under 35 U.S.C. 154(b) by 0 days.

(21) Appl. No.: 16/819,528

(22) Filed: Mar. 16, 2020

(65) Prior Publication Data

US 2020/0288881 A1 Sep. 17, 2020

Related U.S. Application Data

(60) Provisional application No. 62/819,118, filed on Mar. 15, 2019.

(51) Int. Cl.
*A47F 5/11* (2006.01)

(52) U.S. Cl.
CPC ..... *A47F 5/116* (2013.01)

(58) Field of Classification Search
CPC .... A47F 5/10; A47F 5/116; A47F 5/11; A47F 5/112; A47B 43/02; A47B 45/00; A47B 43/00; A47B 47/06; A47B 55/06
USPC ..... 211/207, 174, 175, 149
See application file for complete search history.

(56) References Cited

U.S. PATENT DOCUMENTS

| | | | |
|---|---|---|---|
| 1,827,008 | A | 10/1931 | Huckel |
| 1,912,847 | A | 6/1933 | Earl |
| 1,992,373 | A | 2/1935 | Johnson |
| 2,018,707 | A | 10/1935 | Daller |

(Continued)

FOREIGN PATENT DOCUMENTS

| | | | |
|---|---|---|---|
| DE | 102006043829 | A1 | 3/2008 |
| DE | 102011116238 | A1 | 4/2013 |

(Continued)

OTHER PUBLICATIONS

Leblanc, Rick; "Limits on Export Pallets Creating Corrugated Window of Opportunity; Corrugated Pallet Suppliers Experiencing Renewed Interest for Export, Domestic Markets," http://www.palletenterprise.com/articledatabase/view.asp?articleID-648; 4 pages; Apr. 1, 2002.

*Primary Examiner* — Jonathan Liu
*Assistant Examiner* — Devin K Barnett
(74) *Attorney, Agent, or Firm* — Greensfelder, Hemker & Gale, P.C.

(57) ABSTRACT

A corrugated paper display moveable from a stowed condition to a display condition is described herein. The display has a first rectangular sleeve having opposed lateral edges, a front edge, and a back edge. Two side panels one of each are attached respectively to one of each of the two opposed lateral edges. A back wall is connected to the back edge and the two side panels. A rectangular display compartment extends between the opposed side walls and a shelf is positioned in the rectangular display compartment. A front panel is hingedly connected to the first sleeve and rests on top of the first sleeve when in the stowed condition. When in the deployed condition, the front panel extends from the first sleeve to form a body of a second height which is 1.5 to 2.5 times greater than the first height.

20 Claims, 39 Drawing Sheets

(56) References Cited

U.S. PATENT DOCUMENTS

D104,437 S 5/1937 Bulman
2,150,743 A 3/1939 Mancuso
2,307,992 A * 1/1943 Calhoun ..... A47F 5/112 206/733
2,339,656 A 1/1944 Shina
D146,386 S 2/1947 Shield
D153,188 S 3/1949 Stensgaard
D158,775 S 5/1950 Malkin
D158,776 S 5/1950 Malkin
2,666,531 A 1/1954 Anderson, Jr.
2,706,066 A 4/1955 Wells
2,798,685 A 7/1957 Mooney
2,884,179 A 4/1959 Rossum
2,944,555 A 7/1960 Peel et al.
2,975,890 A 3/1961 Block
2,997,222 A 8/1961 Sperry
3,000,602 A 9/1961 O'Brien
3,026,015 A 3/1962 Severn
3,026,078 A 3/1962 Simkins
3,058,646 A 10/1962 Guyer
3,161,341 A 12/1964 Farquhar
D204,434 S 4/1966 Kingsford
3,480,196 A 11/1969 Simas
3,514,031 A 5/1970 Burgess
3,528,559 A 9/1970 Miller
3,690,118 A 9/1972 Rainwater
3,696,990 A 10/1972 Dewhurst
3,730,417 A 5/1973 Lawson
3,857,494 A 12/1974 Giardini
3,879,053 A 4/1975 Chvala
3,886,348 A 5/1975 Jonathan et al.
3,889,867 A 6/1975 Berg
3,944,128 A 3/1976 Hogan
D239,805 S 5/1976 South
4,004,691 A 1/1977 Wihksne
D244,117 S 4/1977 Naylor
4,085,847 A 4/1978 Jacalone
4,099,813 A 7/1978 Olivan
4,171,741 A 10/1979 Fish
4,283,000 A 8/1981 White
4,292,901 A 10/1981 Cox
4,311,100 A 1/1982 Gardner et al.
4,375,874 A 3/1983 Leotta et al.
4,376,558 A 3/1983 Bandar
4,493,424 A * 1/1985 Smith ..... A47F 5/116 108/165
4,503,973 A 3/1985 Anderson
4,506,790 A 3/1985 Muscari
D278,493 S 4/1985 Brescia et al.
4,602,735 A 7/1986 Aaron
4,610,355 A 9/1986 Maurer
4,618,115 A 10/1986 Belokin, Jr.
4,630,740 A 12/1986 Belokin, Jr.
4,658,984 A 4/1987 Brunner
4,673,092 A 6/1987 Lamson et al.
4,688,716 A 8/1987 Winterling
D292,659 S 11/1987 Svezia et al.
D293,520 S 1/1988 Ovitz, III
4,722,473 A 2/1988 Sandrini et al.
D294,908 S 3/1988 Childress
4,765,492 A 8/1988 Howard et al.
4,793,664 A 12/1988 Jackson
4,826,265 A 5/1989 Hockenberry
4,836,379 A 6/1989 Shaw
4,850,284 A 7/1989 DeGroot et al.
4,852,756 A 8/1989 Holladay
4,863,024 A 9/1989 Booth
4,871,067 A 10/1989 Valenti
4,877,137 A 10/1989 Govang et al.
4,899,929 A 2/1990 Grollman
4,911,084 A 3/1990 Sato et al.
4,936,470 A 6/1990 Prindle
D321,100 S 10/1991 Dorrell
D321,295 S 11/1991 Nuebler
D321,615 S 11/1991 Lavine et al.
5,067,418 A 11/1991 Carter
5,119,740 A 6/1992 Carter
5,125,520 A 6/1992 Kawasaki
5,141,105 A 8/1992 Maye
5,176,265 A 1/1993 Bennett
D332,883 S 2/1993 Staude
5,183,166 A 2/1993 Belokin, Jr. et al.
5,195,440 A 3/1993 Gottlieb
5,213,220 A * 5/1993 McBride ..... A47B 43/00 211/126.16
5,259,631 A 11/1993 Brande
5,269,219 A 12/1993 Juvik-Woods
5,272,990 A 12/1993 Carter
5,315,936 A 5/1994 Smith
D349,202 S 8/1994 Eliades et al.
5,335,593 A 8/1994 Stoddard et al.
D351,076 S 10/1994 Eliades et al.
5,357,875 A 10/1994 Winebarger et al.
5,388,531 A 2/1995 Crews et al.
5,413,053 A 5/1995 Vannatta
5,427,019 A 6/1995 Moorman
5,443,168 A 8/1995 Dyment et al.
D362,768 S 10/1995 Lechleiter et al.
5,458,411 A 10/1995 Moss
D363,840 S 11/1995 Weshler
5,465,672 A 11/1995 Boyse et al.
5,465,851 A * 11/1995 Smith ..... A47F 5/0807 108/162
5,487,344 A 1/1996 Hutchinson
5,487,345 A 1/1996 Winebarger et al.
D369,035 S 4/1996 Potter
D369,043 S 4/1996 Parker
5,520,120 A 5/1996 Badger
5,528,994 A 6/1996 Iseli
5,540,536 A 7/1996 Hoedl
5,543,205 A 8/1996 Liebel
5,590,606 A 1/1997 Crews et al.
5,603,258 A 2/1997 Besaw
5,622,306 A 4/1997 Grigsby et al.
5,630,518 A * 5/1997 Collins ..... A47F 5/112 211/132.1
5,672,412 A 9/1997 Phares et al.
5,678,492 A 10/1997 Pinkstone et al.
5,685,234 A 11/1997 Grigsby et al.
D388,905 S 1/1998 Wells
5,706,953 A 1/1998 Polvere
5,706,959 A * 1/1998 Smith ..... A47F 5/0018 108/165
5,711,423 A 1/1998 Fuller, Jr.
D395,534 S 6/1998 Besaw
5,758,783 A * 6/1998 Maglione ..... A47B 87/0207 211/126.16
5,762,213 A 6/1998 Heneveld, Sr.
5,791,487 A 8/1998 Dixon
5,794,542 A 8/1998 Besaw
5,797,499 A 8/1998 Pinco
D398,461 S 9/1998 Baluk et al.
D398,462 S 9/1998 Baluk et al.
5,809,903 A 9/1998 Young, Jr.
5,816,172 A 10/1998 Carter
5,826,732 A 10/1998 Ragsdale
5,832,841 A 11/1998 Crews et al.
5,881,652 A 3/1999 Besaw
D412,253 S 7/1999 Brozak, Jr.
5,918,744 A 7/1999 Bringard et al.
5,950,914 A 9/1999 Dunton et al.
5,980,008 A 11/1999 Stoever
5,996,366 A 12/1999 Renard
5,996,510 A 12/1999 Harpman et al.
D419,275 S 1/2000 Carter
D419,744 S 1/2000 Carter
6,012,399 A 1/2000 Carter
6,070,726 A 1/2000 Carter
6,076,475 A 6/2000 Kuhn et al.
D428,738 S 8/2000 Brozak, Jr.
6,126,131 A 10/2000 Tietz
6,135,030 A 10/2000 Besaw
D433,782 S 11/2000 Carter
D433,839 S 11/2000 Culbertson

(56) References Cited

U.S. PATENT DOCUMENTS 6,145,671 A 11/2000 Riga et al.
6,145,794 A * 11/2000 Smith ..... A47F 5/108 211/132.1
6,164,215 A 12/2000 Cook et al.
6,189,778 B1 2/2001 Kanter
6,302,283 B1 * 10/2001 Yeh ..... A47F 5/116 108/109
D453,057 S 1/2002 Sewell
6,354,229 B1 3/2002 Heidtke
6,357,587 B1 3/2002 Melms, Jr.
6,360,465 B1 3/2002 Simpson
6,394,003 B1 5/2002 Lacy, III
6,394,290 B1 * 5/2002 Walsh ..... A47F 5/114 108/115
D461,334 S 8/2002 Johnson et al.
D464,498 S 10/2002 Riga et al.
6,510,982 B2 1/2003 White et al.
6,585,118 B2 7/2003 Kellogg
6,612,247 B1 9/2003 Pistner et al.
6,612,669 B2 * 9/2003 Grueneberg ..... A47B 43/02 108/165
6,659,295 B1 12/2003 De Land et al.
6,715,623 B2 4/2004 Broerman
6,729,484 B2 5/2004 Sparkowski
6,769,368 B2 8/2004 Underbrink et al.
D495,901 S 9/2004 Bosman
6,814,245 B2 11/2004 Leclerc et al.
6,902,074 B2 6/2005 Albrecht
6,905,021 B2 6/2005 Polumbaum et al.
D509,382 S 9/2005 Ralle
6,951,300 B2 10/2005 Caille et al.
6,966,447 B2 * 11/2005 Hiltke ..... A47F 5/116 211/132.1
7,007,615 B2 3/2006 Grueneberg
D521,275 S 5/2006 Dusenberry
7,036,196 B2 5/2006 Salatin et al.
7,066,342 B2 6/2006 Baechle et al.
7,066,380 B2 6/2006 Blake
7,089,872 B2 8/2006 Wintermute, II et al.
7,111,735 B2 9/2006 Lowry
7,137,517 B2 11/2006 Lowry et al.
D533,734 S 12/2006 Campbell
7,191,906 B1 3/2007 Pinco
7,234,604 B2 6/2007 Eisele
7,252,200 B1 * 8/2007 Hester ..... A47F 5/116 211/126.16
D566,989 S 4/2008 Mason
D576,426 S 9/2008 Yuen-Schat et al.
D578,804 S 10/2008 Norman et al.
7,546,926 B2 6/2009 Stolle et al.
7,546,927 B2 6/2009 Lowry
D603,189 S 11/2009 Ralle
7,650,996 B2 1/2010 Mark
7,677,433 B2 3/2010 Little
7,703,665 B2 4/2010 McGowan
7,703,864 B2 4/2010 Moser
7,717,265 B2 5/2010 Honkawa et al.
7,726,474 B2 6/2010 Berger et al.
7,828,169 B2 11/2010 Robinson et al.
7,992,716 B2 8/2011 Jackson
8,002,171 B2 8/2011 Ryan et al.
8,141,713 B2 3/2012 Farkas et al.
8,157,112 B2 4/2012 Bojie
8,317,039 B2 11/2012 Norman
8,485,370 B2 7/2013 Dewhurst
8,857,633 B2 10/2014 Dewhurst
8,985,328 B2 * 3/2015 Slaats ..... B65D 19/04 206/386
9,045,250 B2 6/2015 Henderson et al.
9,198,508 B1 * 12/2015 Kufel ..... A47B 47/0075
9,211,021 B2 12/2015 Smith
9,428,298 B2 8/2016 Bersamin et al.
9,474,389 B2 10/2016 Pfeifer et al.
9,487,321 B2 11/2016 Luke
9,743,783 B1 8/2017 Bersamin
9,844,282 B2 12/2017 Smith
9,907,414 B2 3/2018 Heuer
9,918,569 B1 3/2018 Abel
9,919,829 B2 3/2018 Jolley
9,938,040 B2 4/2018 Buscema
9,969,523 B2 5/2018 Ayerst
10,117,529 B2 11/2018 Abel
10,123,635 B2 11/2018 Lilja
10,159,362 B2 12/2018 Smith
10,306,999 B2 6/2019 Smith
10,315,798 B2 * 6/2019 Pfeifer ..... B65D 19/0012
10,448,758 B1 10/2019 Abel
10,463,176 B1 11/2019 Sells
10,470,591 B1 11/2019 Heiden et al.
10,524,589 B2 * 1/2020 Donegan ..... A47B 55/06
10,531,750 B1 1/2020 Heiden et al.
10,568,422 B2 * 2/2020 Gibbons, Jr. ..... A47B 43/02
10,568,439 B2 2/2020 Bersamin
2002/0189507 A1 12/2002 Benner
2003/0042828 A1 3/2003 Bonin
2003/0111383 A1 6/2003 Qiu et al.
2004/0195195 A1 * 10/2004 Mason ..... A47F 5/0018 211/134
2005/0252872 A1 11/2005 Eisele
2005/0274684 A1 12/2005 Swanson
2006/0006096 A1 1/2006 Funk
2006/0283775 A1 12/2006 Mark
2007/0193479 A1 8/2007 Slaats
2007/0272639 A1 11/2007 Alexander
2008/0173602 A1 * 7/2008 Field ..... A47F 5/116 211/149
2009/0107940 A1 4/2009 Norman et al.
2009/0127150 A1 5/2009 Meers
2010/0006529 A1 1/2010 Groff et al.
2010/0025344 A1 2/2010 Virvo
2010/0133215 A1 6/2010 Norman
2011/0000955 A1 1/2011 Manteufel et al.
2011/0049072 A1 3/2011 Dewhurst
2011/0266177 A1 11/2011 Lowry et al.
2012/0074037 A1 3/2012 Orschak et al.
2012/0305512 A1 12/2012 L'Hotel
2013/0097903 A1 4/2013 Gerstner
2013/0213915 A1 8/2013 Pfeifer et al.
2014/0217047 A1 8/2014 Frost
2015/0041420 A1 * 2/2015 Zelek ..... A47F 5/10 211/149
2015/0136720 A1 5/2015 Miller
2016/0066711 A1 3/2016 Mestres Armengol et al.
2017/0079449 A1 3/2017 Smith
2017/0295927 A1 10/2017 Gibbons, Jr. et al.
2018/0042405 A1 * 2/2018 Lilja ..... A47F 5/116
2018/0070747 A1 3/2018 Smith
2018/0092461 A1 4/2018 Brady et al.
2018/0130382 A1 5/2018 Hinch et al.
2018/0146803 A1 5/2018 Urban
2018/0160825 A1 6/2018 Abel
2018/0289178 A1 10/2018 McMillan-Sweat et al.
2019/0008290 A1 1/2019 Ertl
2019/0069694 A1 3/2019 Smith
2019/0150611 A1 * 5/2019 Burnett ..... A47B 55/06
2020/0037787 A1 2/2020 Pratsch
2020/0113355 A1 4/2020 Hara et al.
2020/0297132 A1 * 9/2020 Nguyen ..... A47F 5/116
2020/0375375 A1 * 12/2020 Robinson ..... A47F 5/116

FOREIGN PATENT DOCUMENTS

EP 0629557 A1 12/1994
FR 2984705 A3 6/2013
JP 06278746 A 10/1994
WO 2008127499 A1 10/2008

* cited by examiner

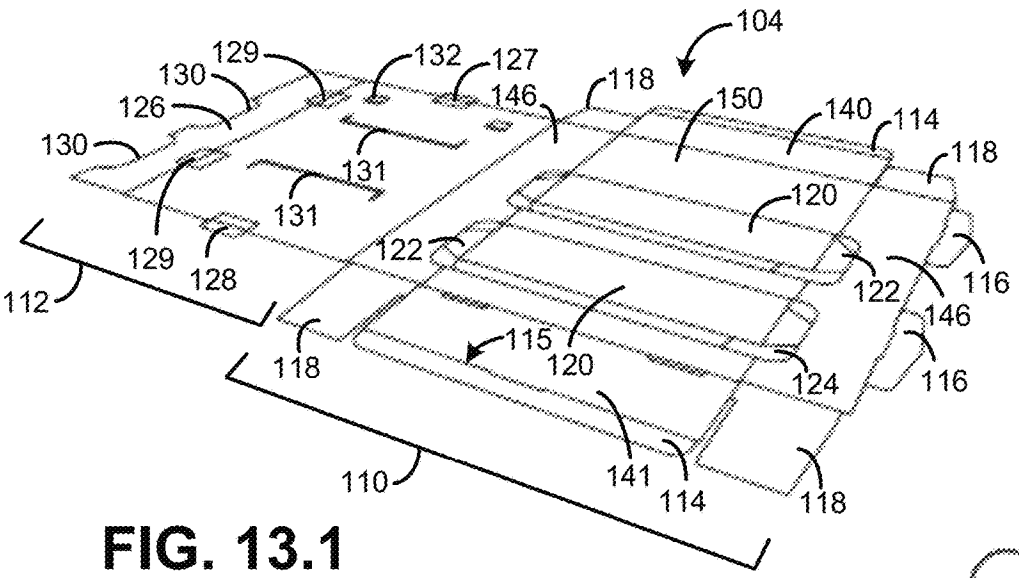
FIG. 13.1
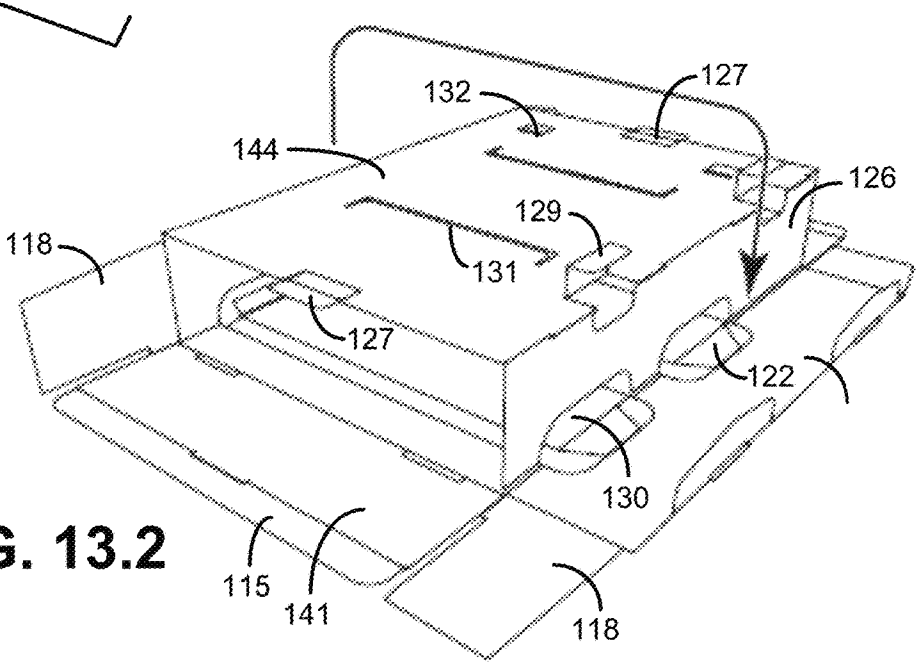
FIG. 13.2

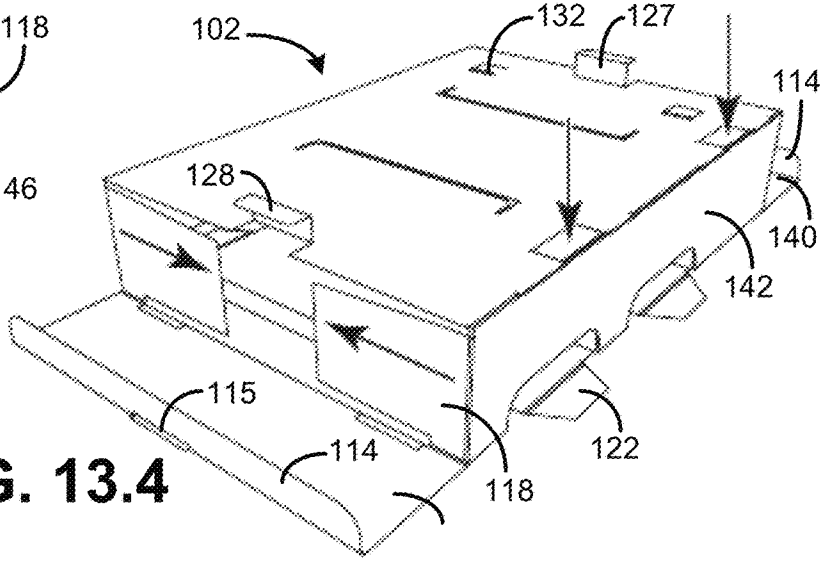
FIG. 13.4
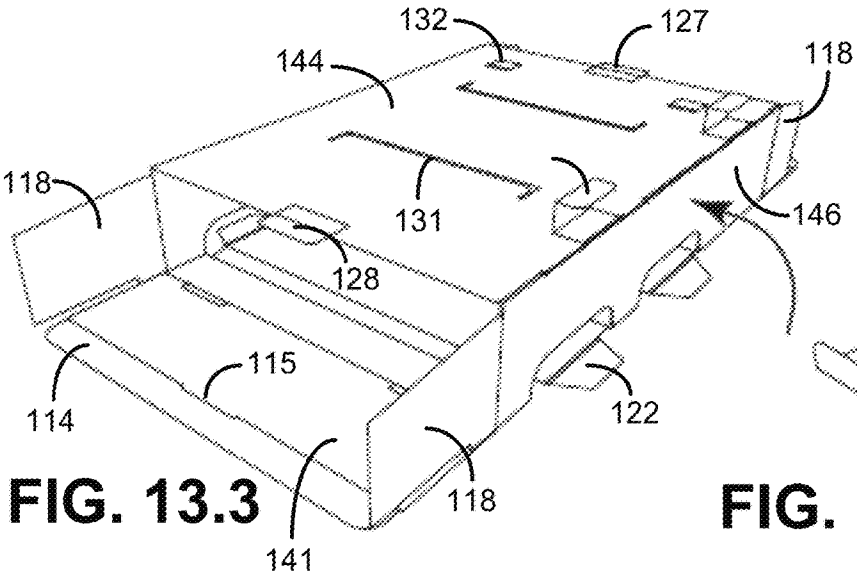
FIG. 13.3
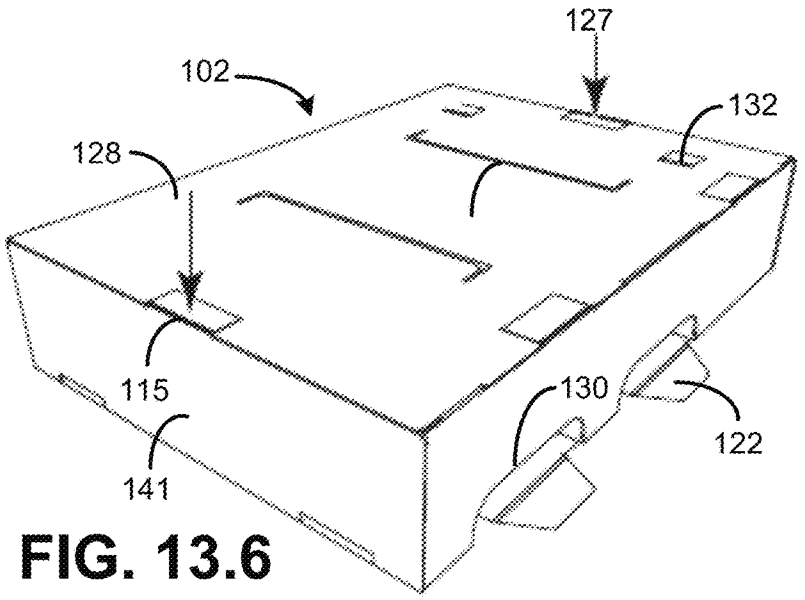
FIG. 13.6
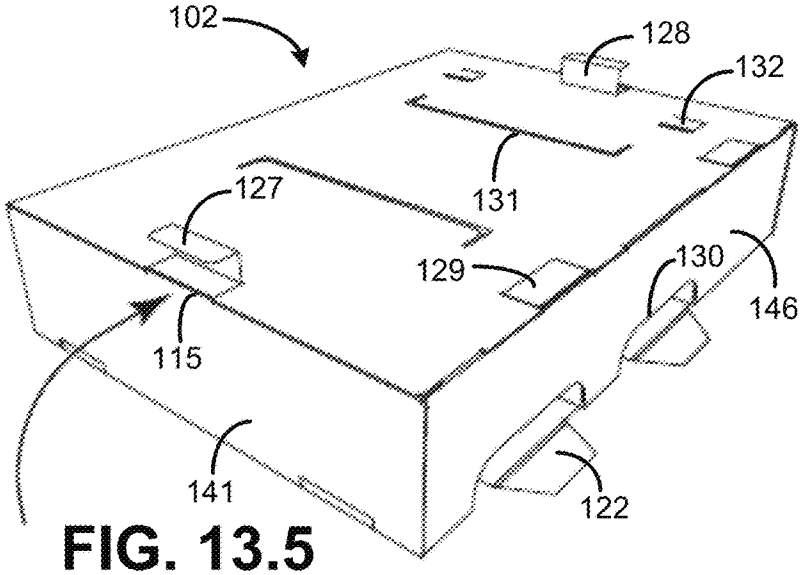
FIG. 13.5

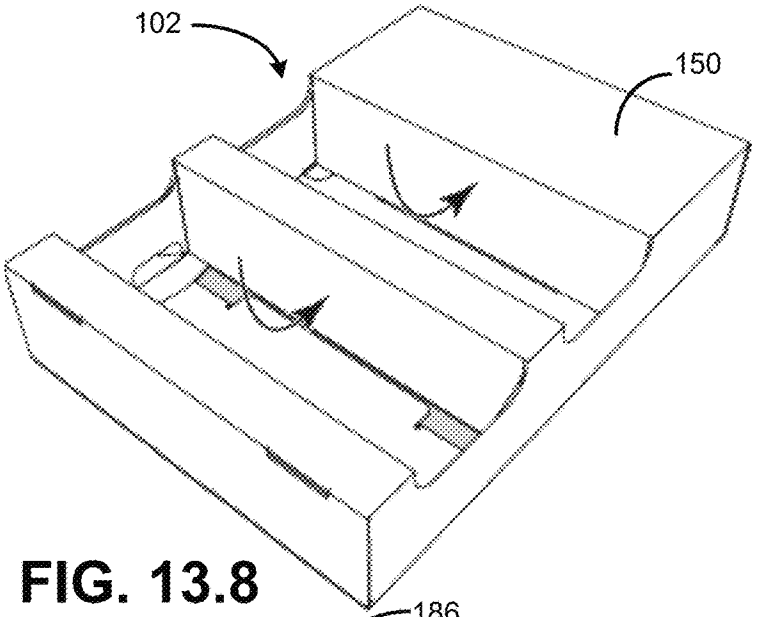
FIG. 13.8
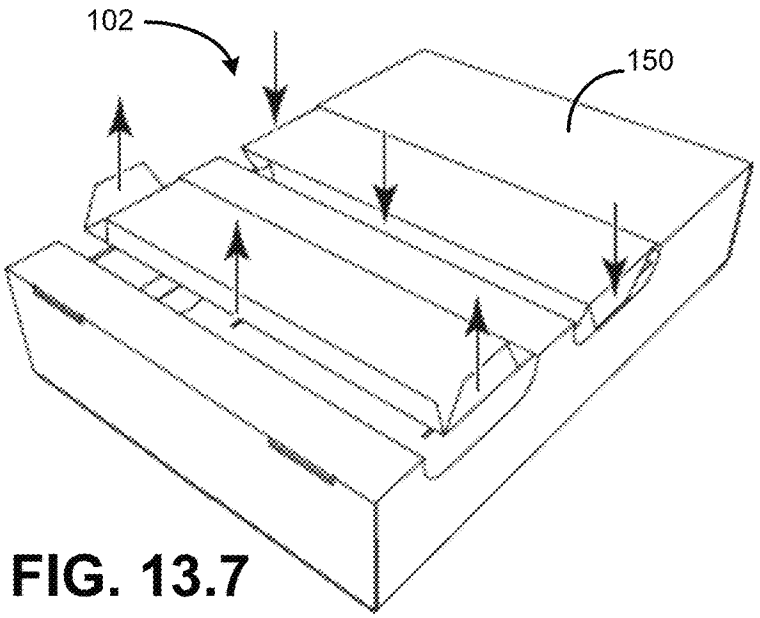
FIG. 13.7
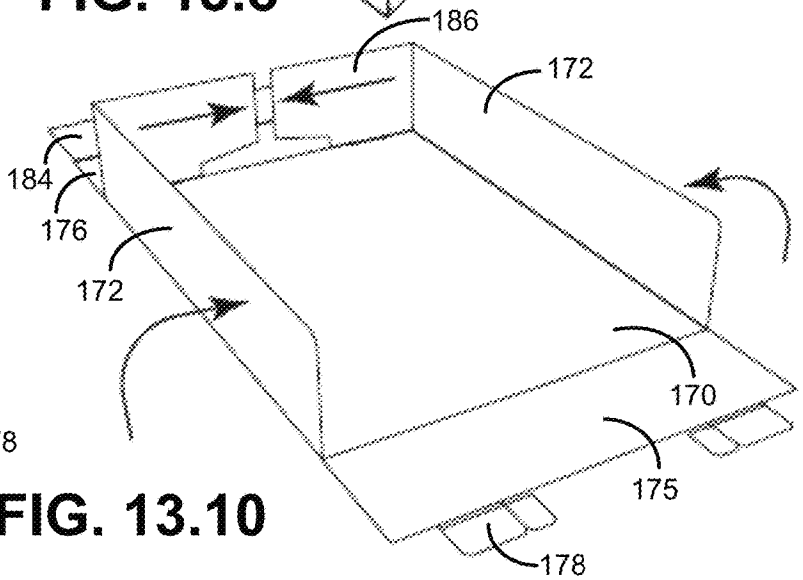
FIG. 13.10
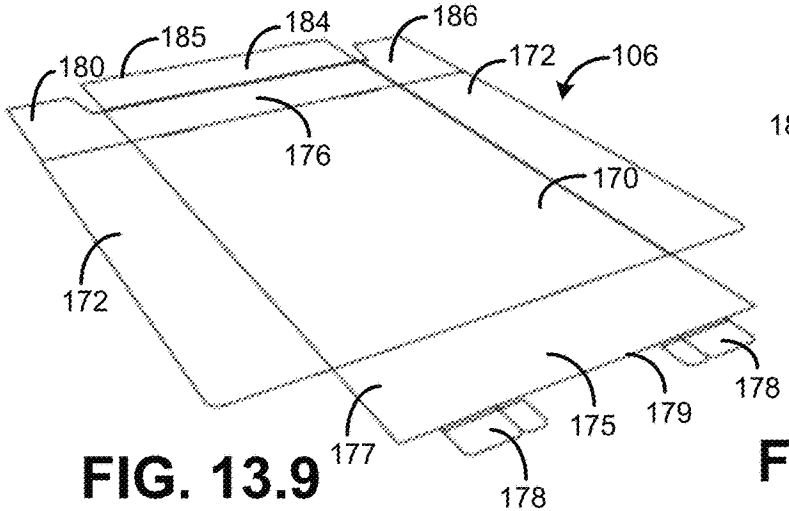
FIG. 13.9

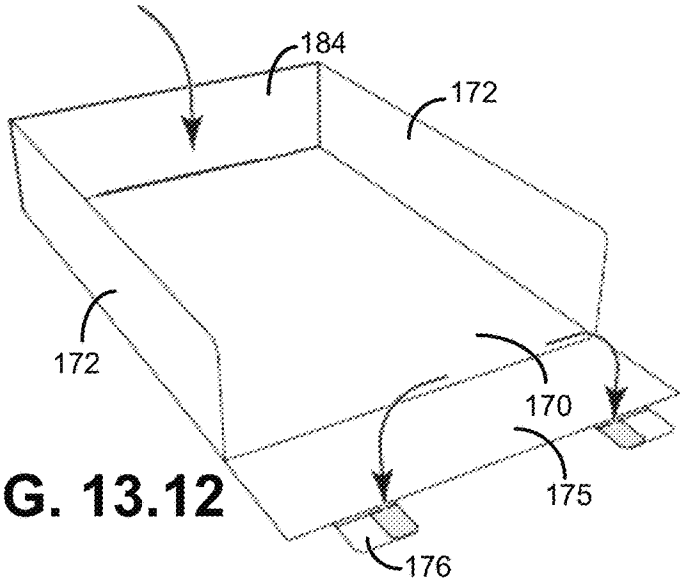
FIG. 13.12
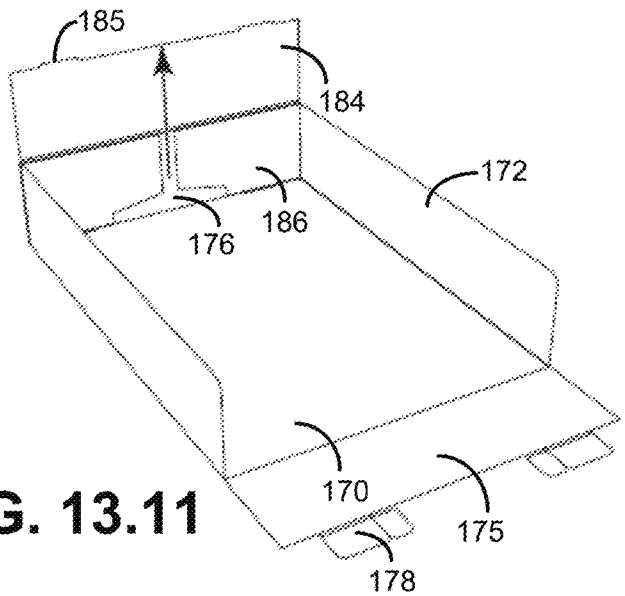
FIG. 13.11
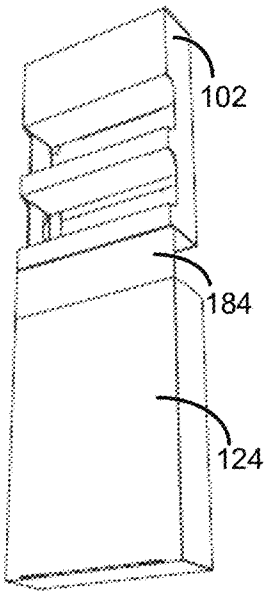
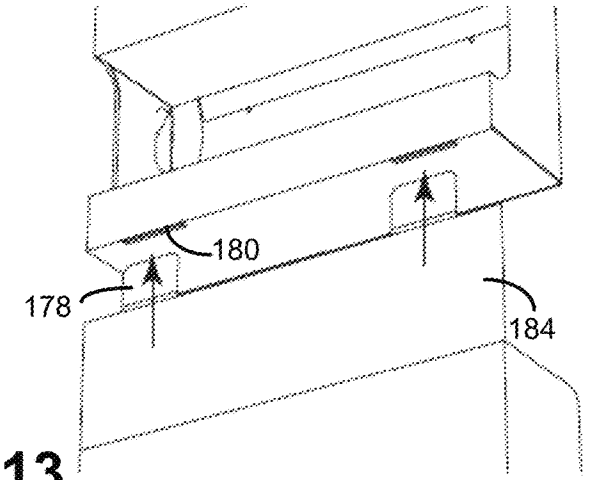
FIG. 13.13

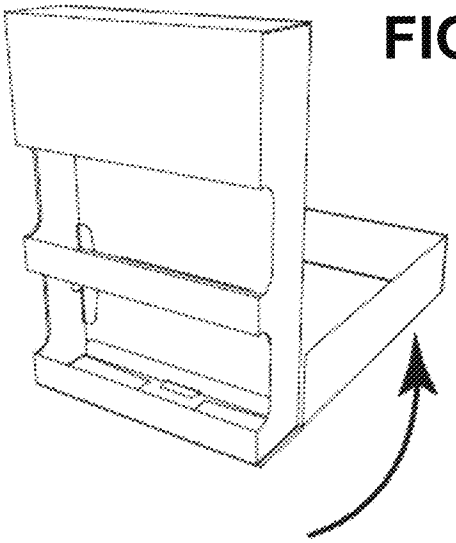
FIG. 13.14
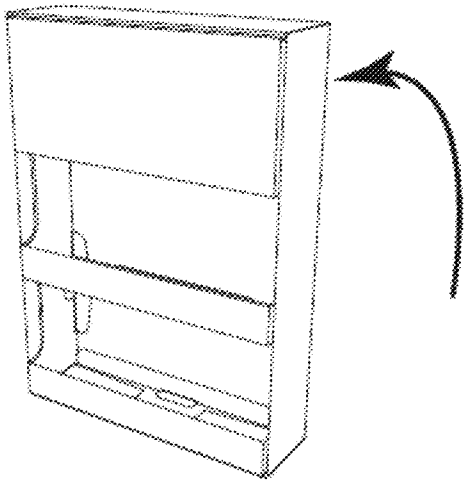
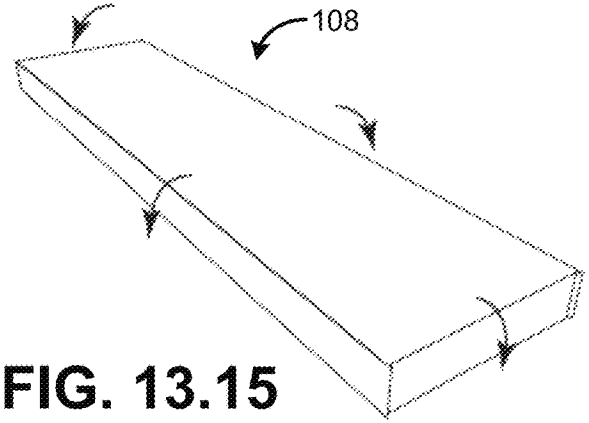
FIG. 13.15
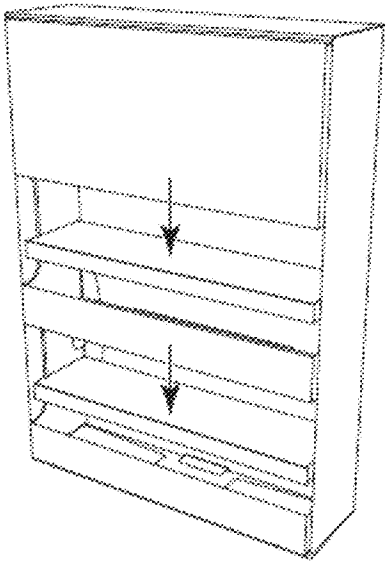
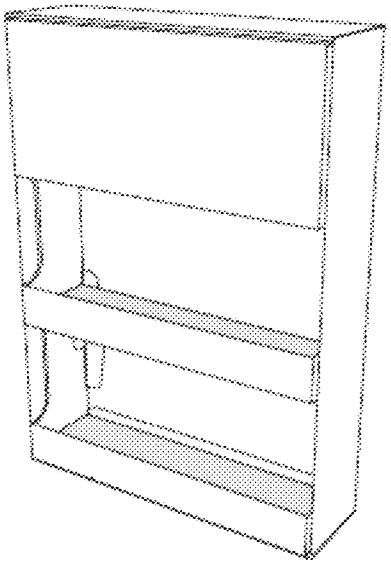
FIG. 13.16

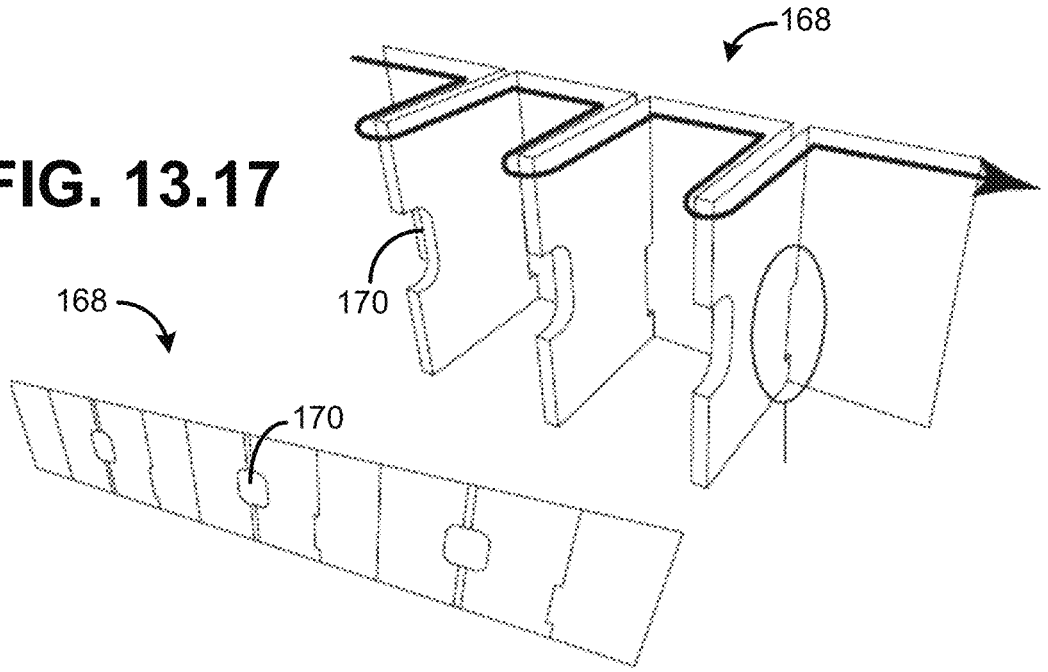
FIG. 13.17
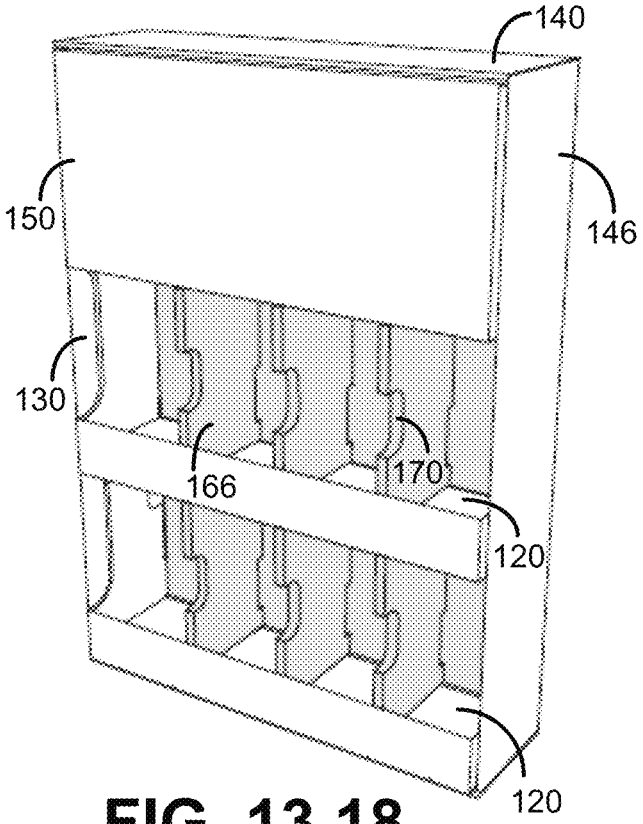
FIG. 13.18

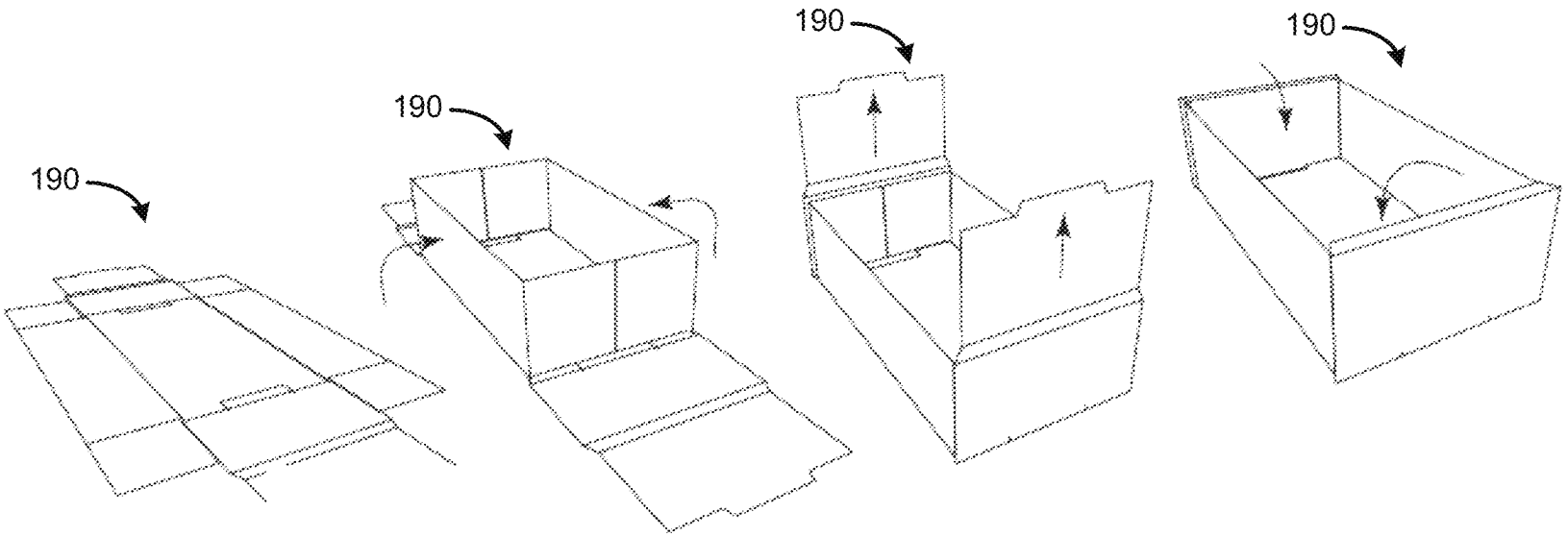
FIG. 13.19

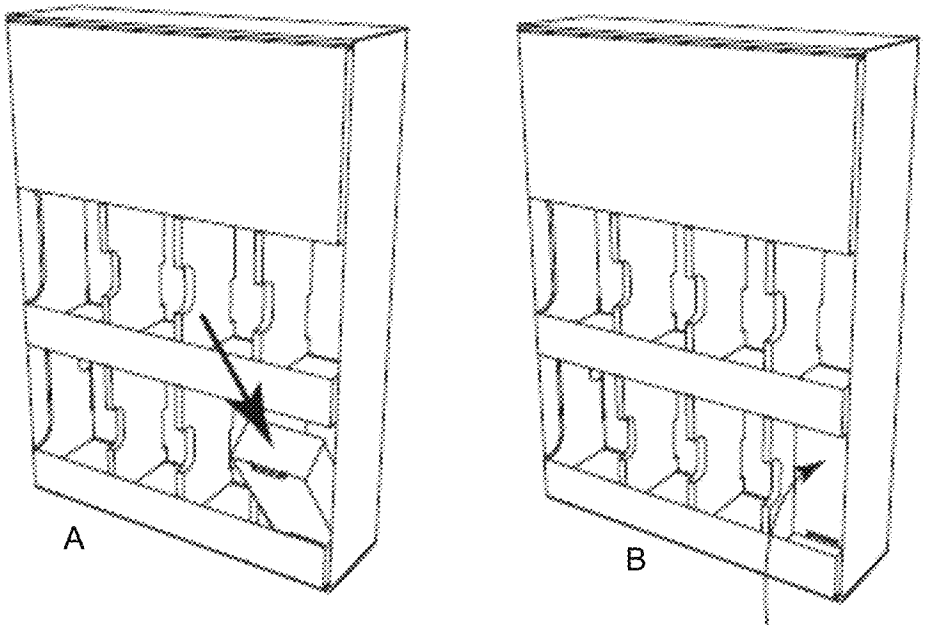
FIG. 13.21
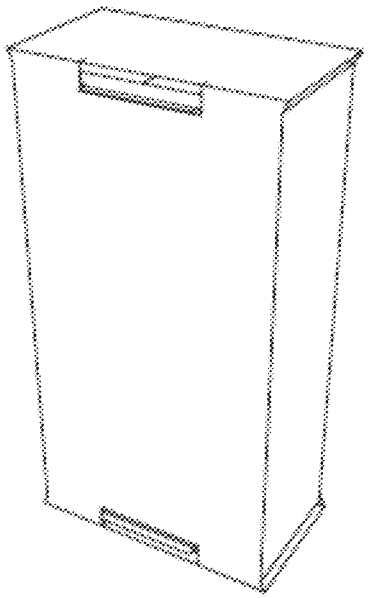
FIG. 13.20

FIG. 21.1
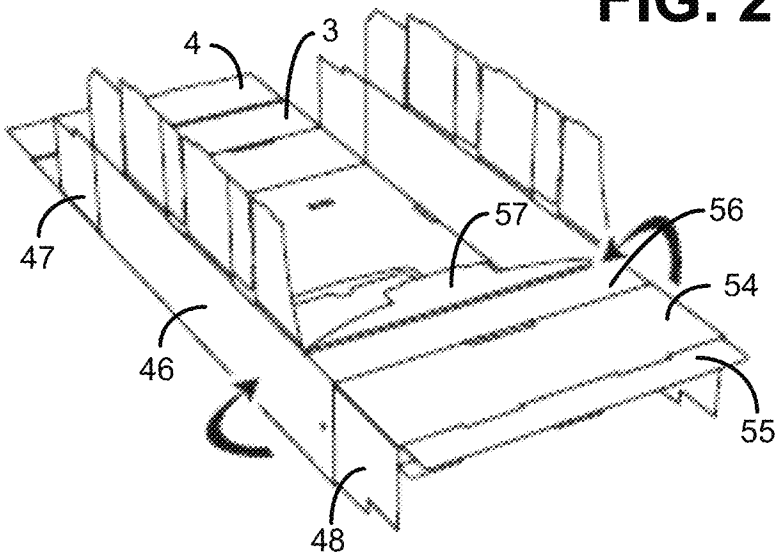
FIG. 21.2
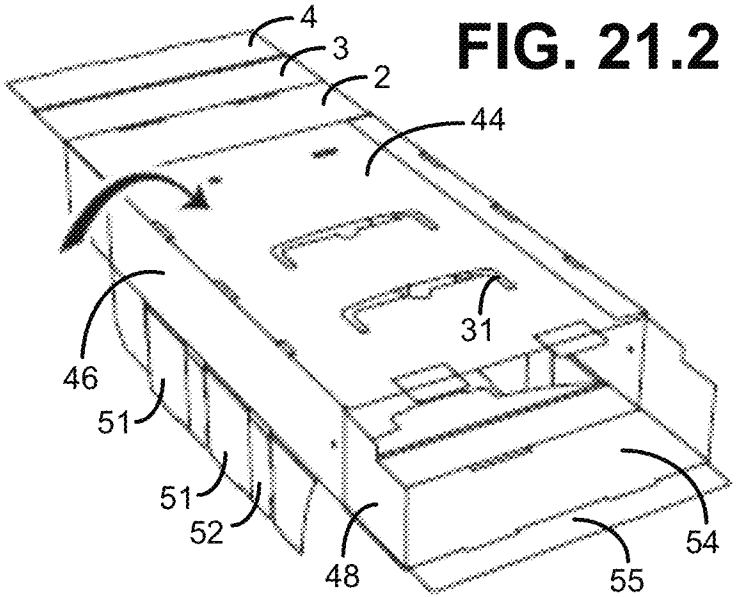

FIG. 21.3
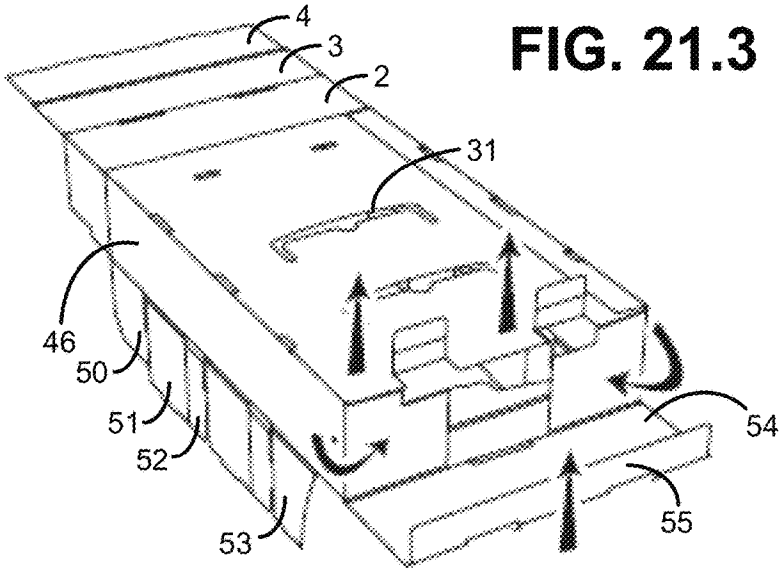
FIG. 21.4
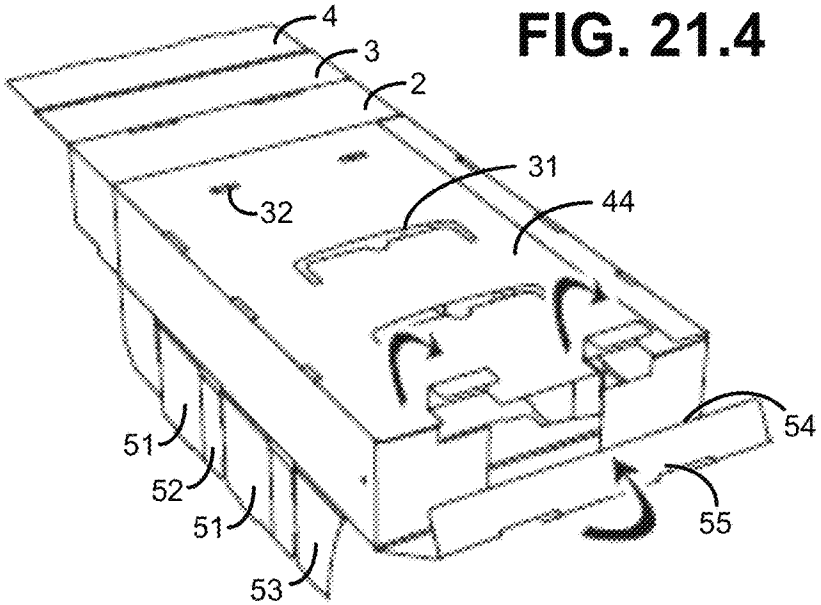

FIG. 21.5
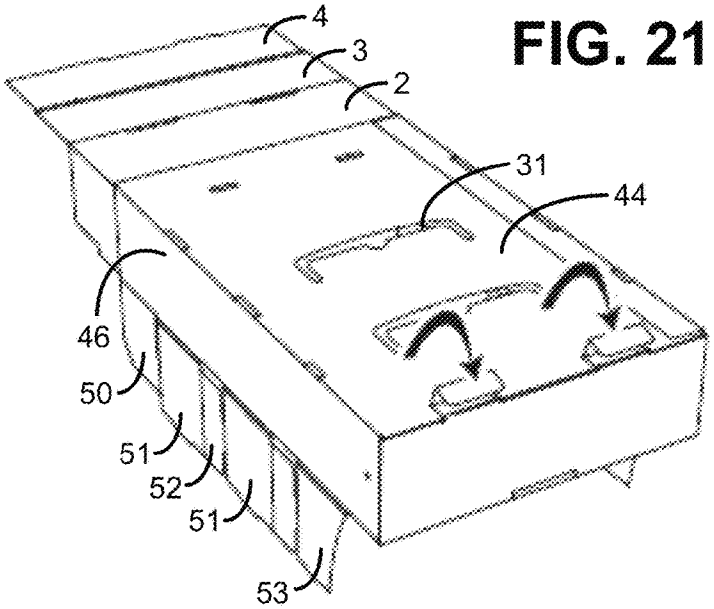
FIG. 21.6
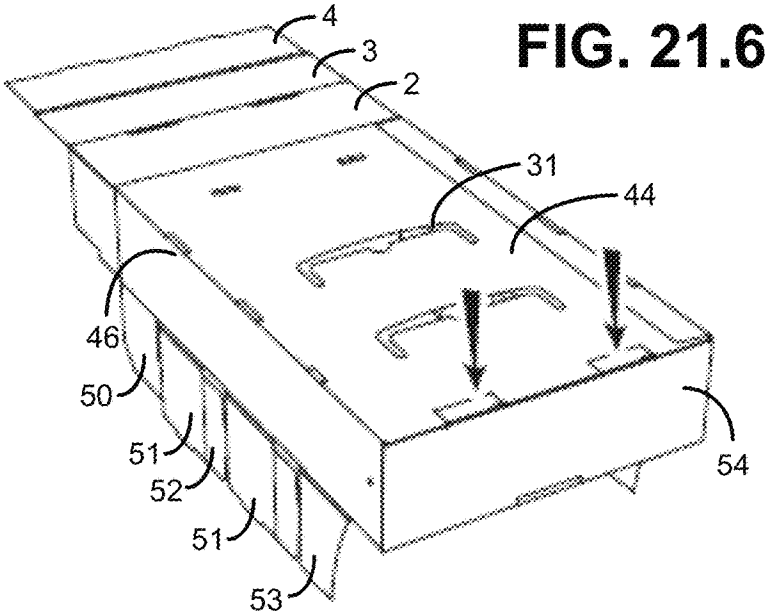

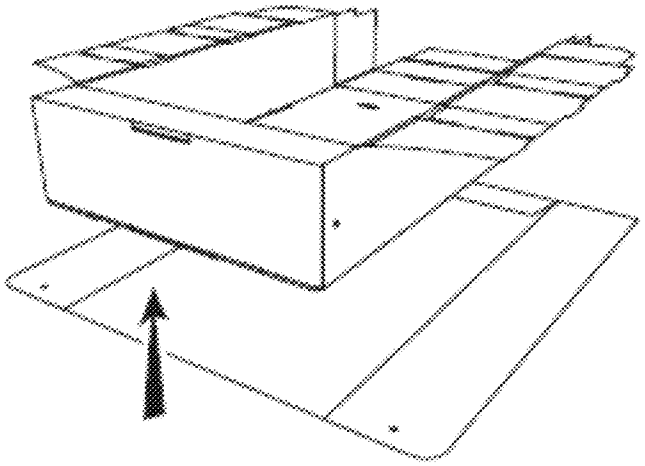
FIG. 21.8
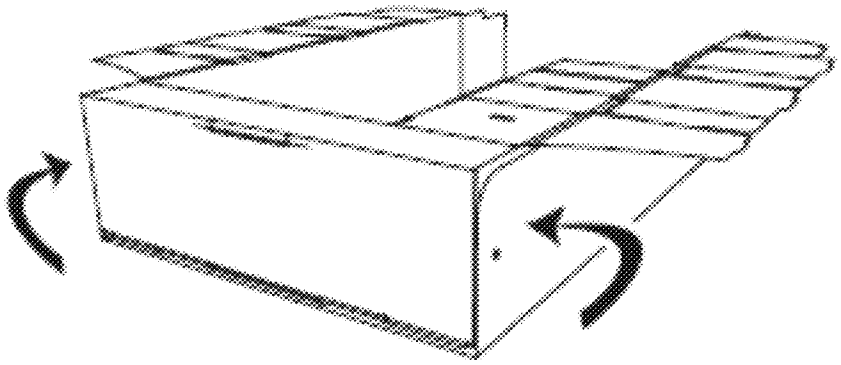
FIG. 21.9
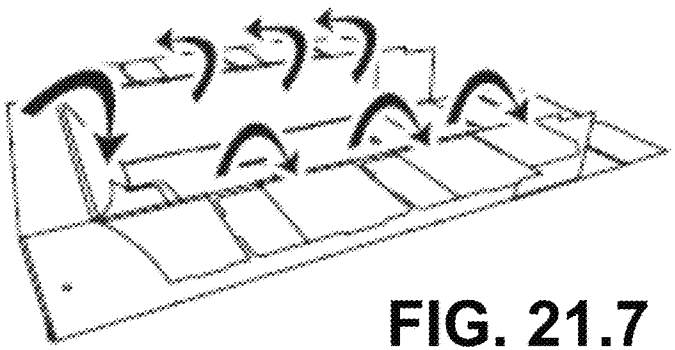
FIG. 21.7

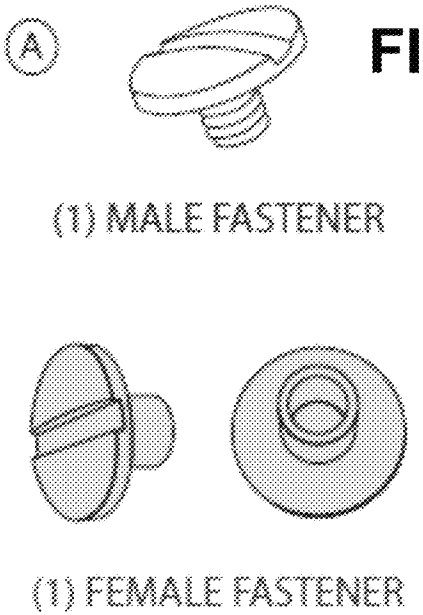
FIG. 21.10
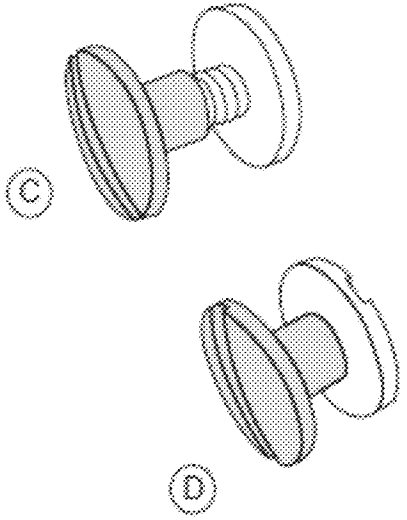
FIG. 21.11
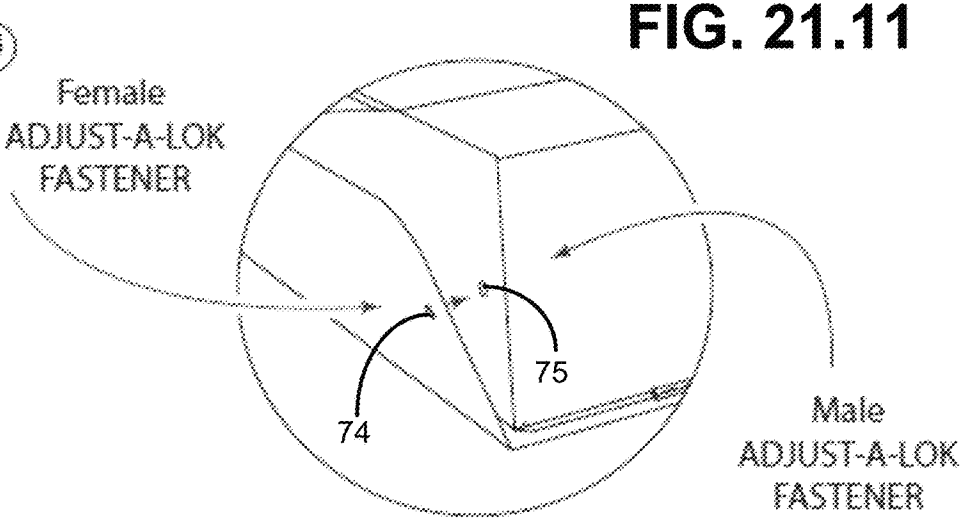

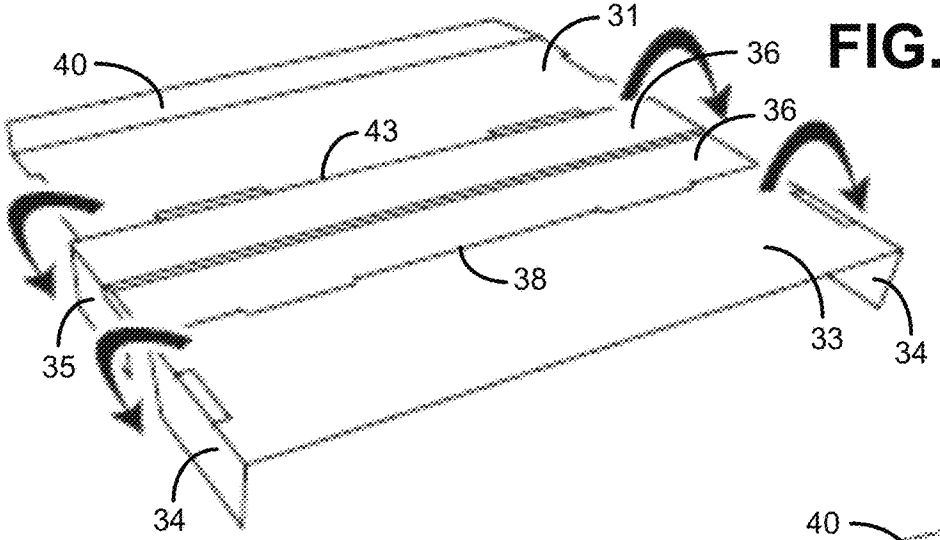
FIG. 21.12
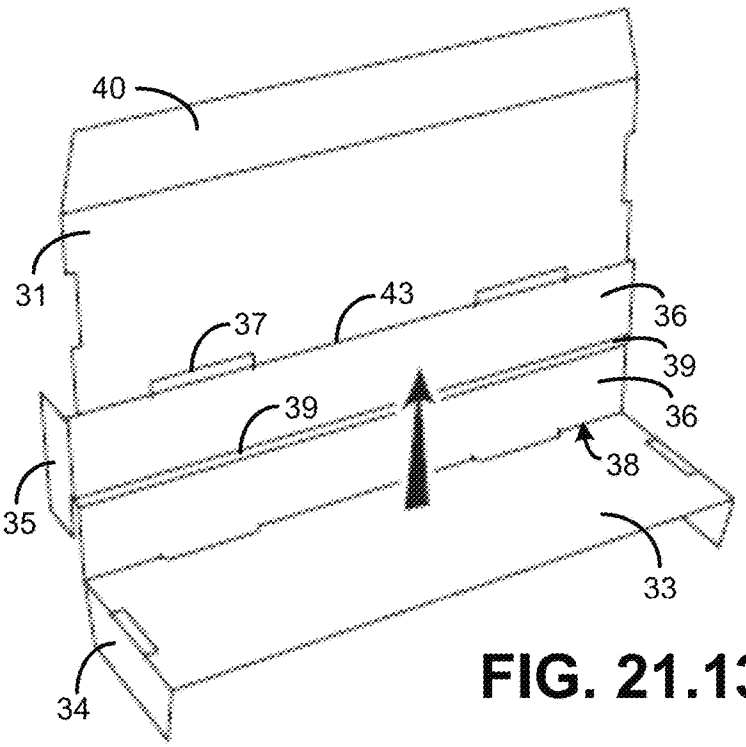
FIG. 21.13

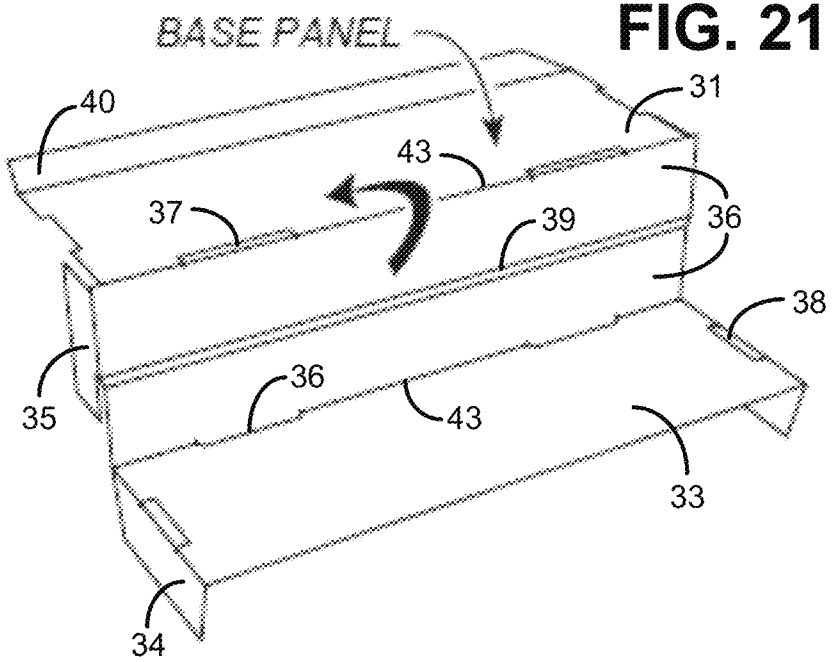
FIG. 21.14
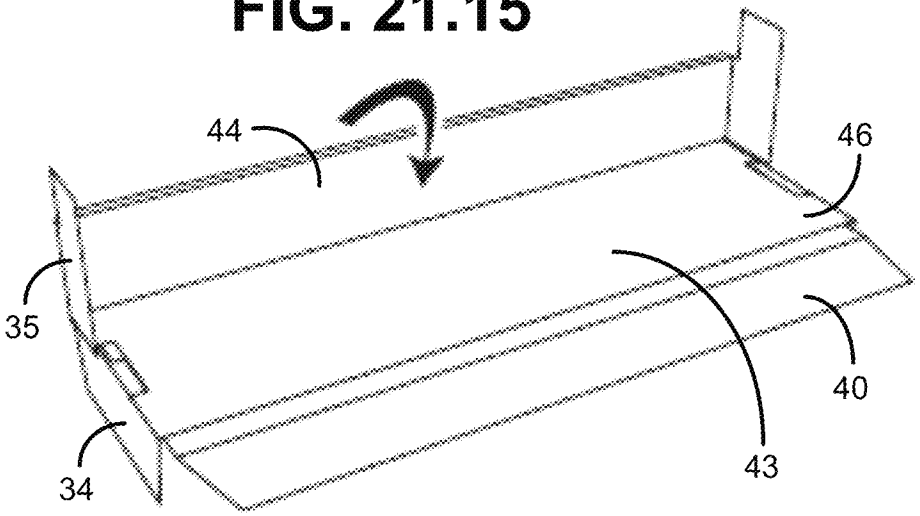
FIG. 21.15

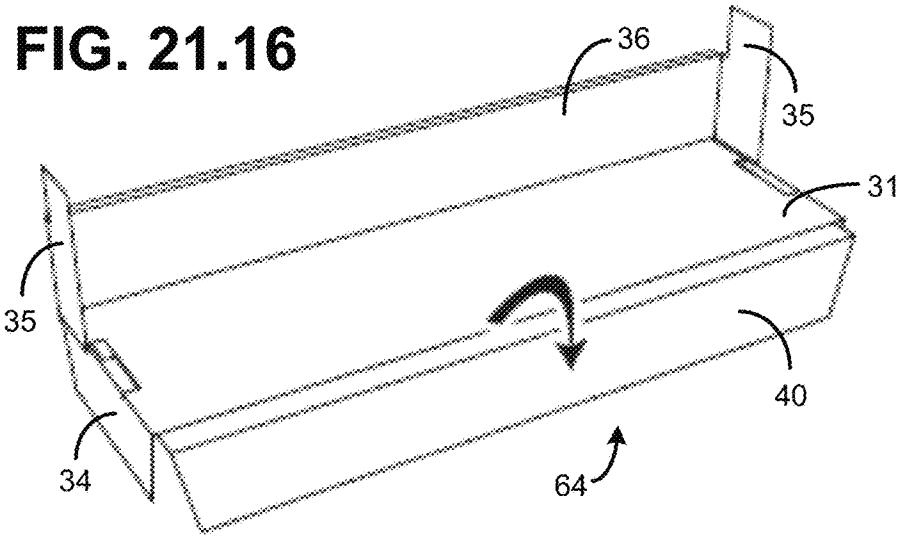
FIG. 21.16
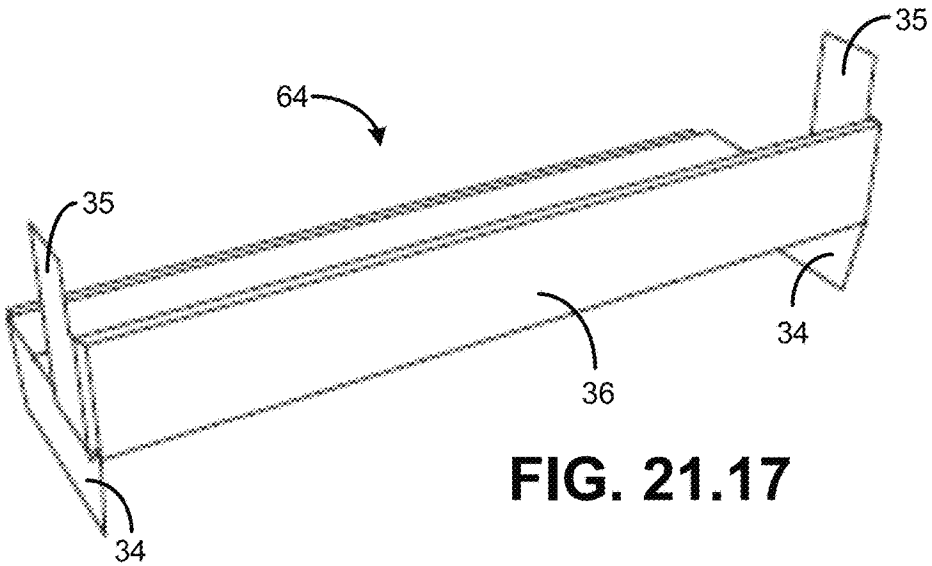
FIG. 21.17

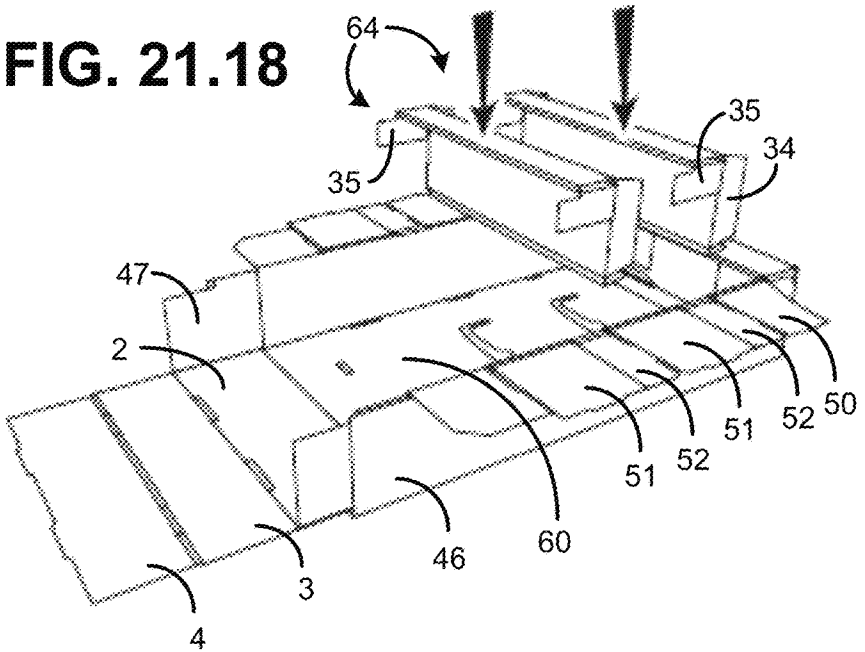
FIG. 21.18
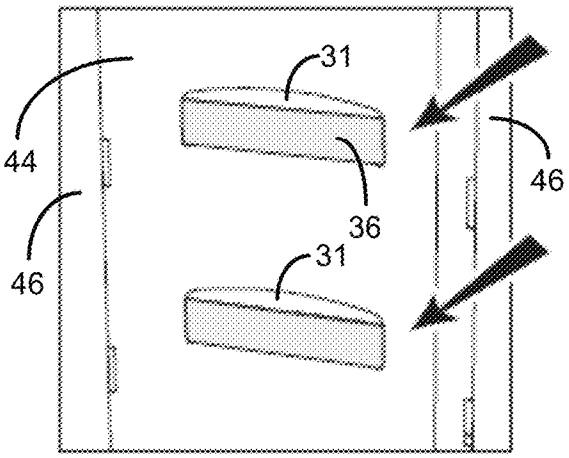
FIG. 21.20
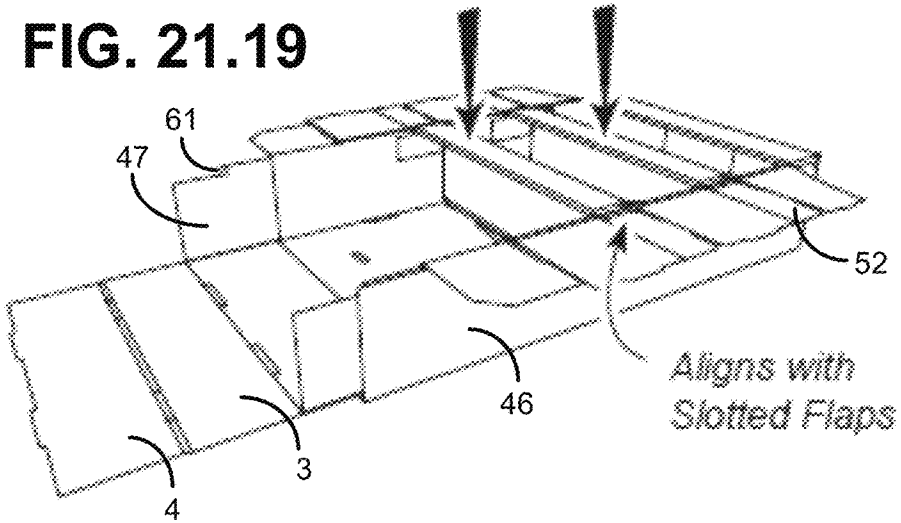
FIG. 21.19

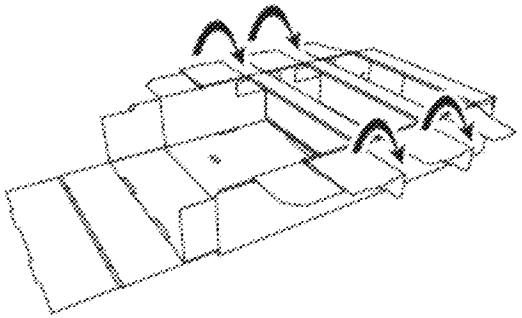
FIG. 21.21
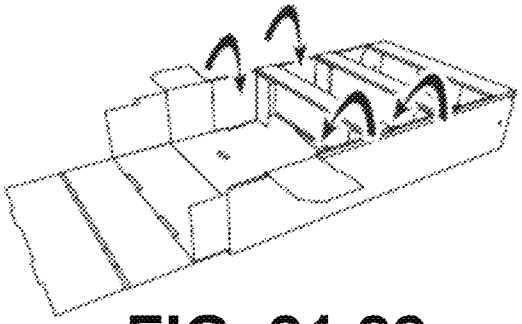
FIG. 21.22
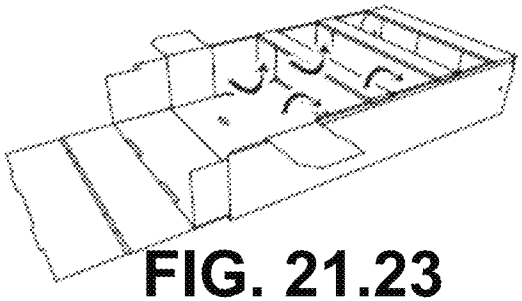
FIG. 21.23
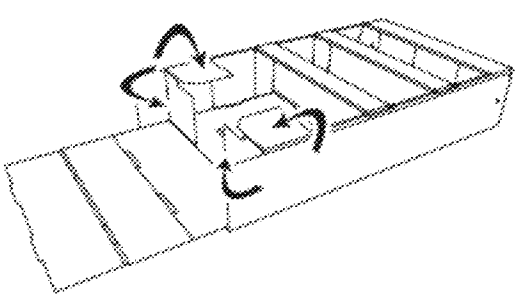
FIG. 21.24
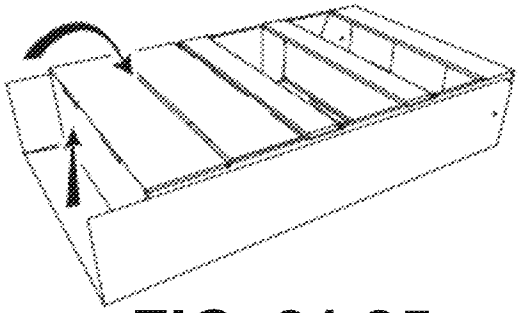
FIG. 21.25
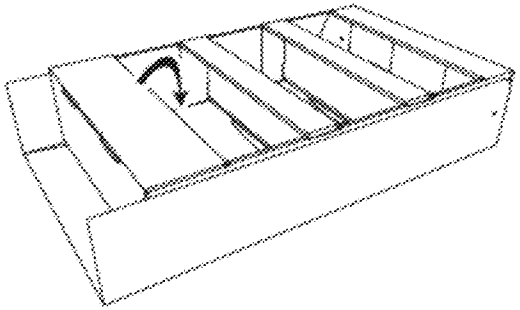
FIG. 21.26

FULL WING DISPLAY

CROSS-REFERENCE TO RELATED APPLICATIONS

The present invention claims priority to and the benefit of U.S. Provisional Patent Application No. 62/819,118 filed Mar. 15, 2019, the contents of which are incorporated herein by reference and made a part hereof.

FEDERALLY SPONSORED RESEARCH OR DEVELOPMENT

N/A

FIELD OF THE INVENTION

Corrugated paperboard displays for holding, retaining, and the controlled dispensing of packaged goods in a retail sales environment.

DESCRIPTION OF THE PRIOR ART

Paperboard displays are widely used to display products for sale in a retail environment. Many such displays are dedicated to holding and supporting product and leave little room for textual and graphical information about the product. The present invention is directed to a display that provides a large surface area of print space when in a deployed condition but much less surface area when in a stowed condition.

SUMMARY OF THE INVENTION

A corrugated paper display moveable from a stowed condition to a display condition is described herein. The corrugated paper display has a first rectangular sleeve folded from a first blank of corrugated paper having a back wall panel, a front wall panel, a top surface panel, and two opposed side wall panels. Each of the side wall panels having a first lateral edge and a second lateral edge opposed to the first lateral edge. The first lateral edge is connected respectively to opposed lateral edges of the back wall. The second lateral edge is connected to a segmented shelf support panel. The segmented shelf support panel has a pair of shelf support flaps separated by a gap. The shelf support flaps are hingedly connected to the shelf support panel and are folded 180° downward in contact with an inner surface of the side wall from which it depends to support a shelf. A shelf is positioned in the gap and is folded from a second blank of corrugated paper. The shelf is supported at opposed ends by the shelf support flaps when the display is in the deployed condition. The display has a third panel folded from a third blank of corrugated material and has a front panel and two side panels extending from opposed lateral edges of the front panel and extending orthogonally therefrom. When in the stowed condition, a first planar surface of the front panel is in contact with a portion of the first rectangular sleeve and is stacked on top thereof to form a body having a first height. When in the deployed condition, the third panel is hingedly connected to the first rectangular sleeve to form a body of a second height which is 1.5 to 2.5 times greater than the first height. A hinge connects the third panel to the first rectangular sleeve to allow movement from the stowed condition to the deployed condition.

Also disclosed is a corrugated paper display moveable from a stowed condition to a deployed condition. The display has a back wall panel, a front wall panel, a top surface panel, and two opposed side wall panels. Each of the two opposed side walls have a first lateral edge and a second lateral edge opposed to the first lateral edge. The first lateral edge is connected respectively to opposed lateral edges of the back wall. The second lateral edge is connected to a segmented shelf support panel. The segmented shelf support panel has a pair of a shelf support flap and a gap in vertical spaced relationship when the display is in the deployed condition. The shelf support flaps are hingedly connected to the shelf support panel and are folded 180° downward in contact with an inner surface of the side wall from which it depends to support a shelf. The display has a first shelf and a second shelf positioned in the gaps. A third panel is folded from a fourth blank of corrugated material and has a front panel and two side panels extending from opposed lateral edges of the front panel and extend orthogonally therefrom. When in the stowed condition a first planar surface of the front panel is in contact with a portion of the first rectangular sleeve and is stacked on top thereof to form a body having a first height. When in the deployed condition, the third panel is hingedly connected to the first rectangular sleeve to form a body of a second height which is 1.5 to 2.5 times greater than the first height. A hinge connects the third panel to the first rectangular sleeve to allow movement from the stowed condition to the deployed condition.

Other features and advantages of the invention will be apparent from the following specification taken in conjunction with the following Figures and Attachments.

BRIEF DESCRIPTION OF THE DRAWINGS

To understand the present invention, it will now be described by way of example, with reference to the accompanying drawings in which:

FIGS. 13.1-13.21 illustrate the steps of erecting a display from the components shown in FIGS. 8-12.

FIGS. 21.1-21.26 illustrate the steps of erecting a display from the components shown in FIGS. 1-7.

DETAILED DESCRIPTION

Figure 1:
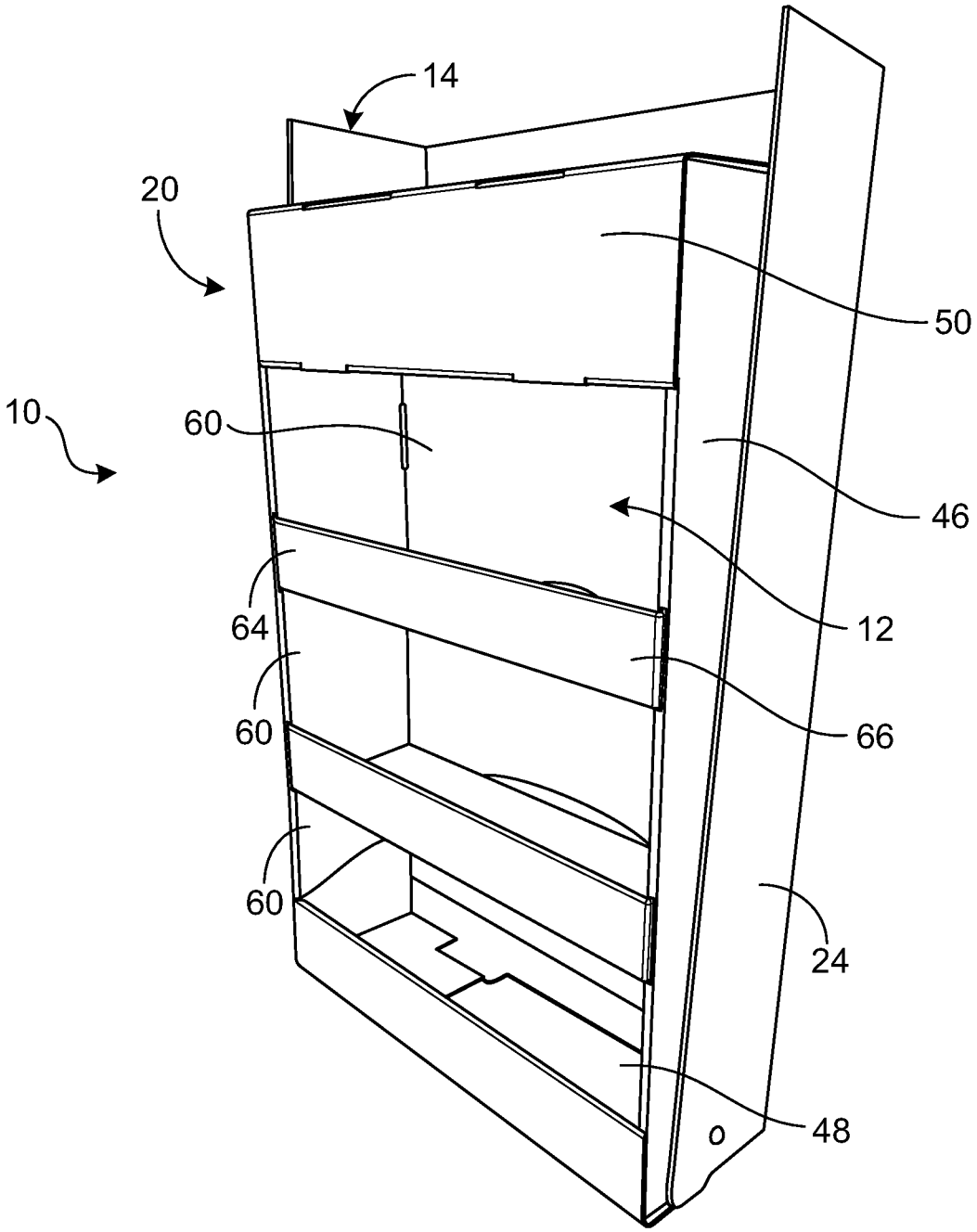
FIG. 1 is a perspective view of a display in a stowed condition.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 2:
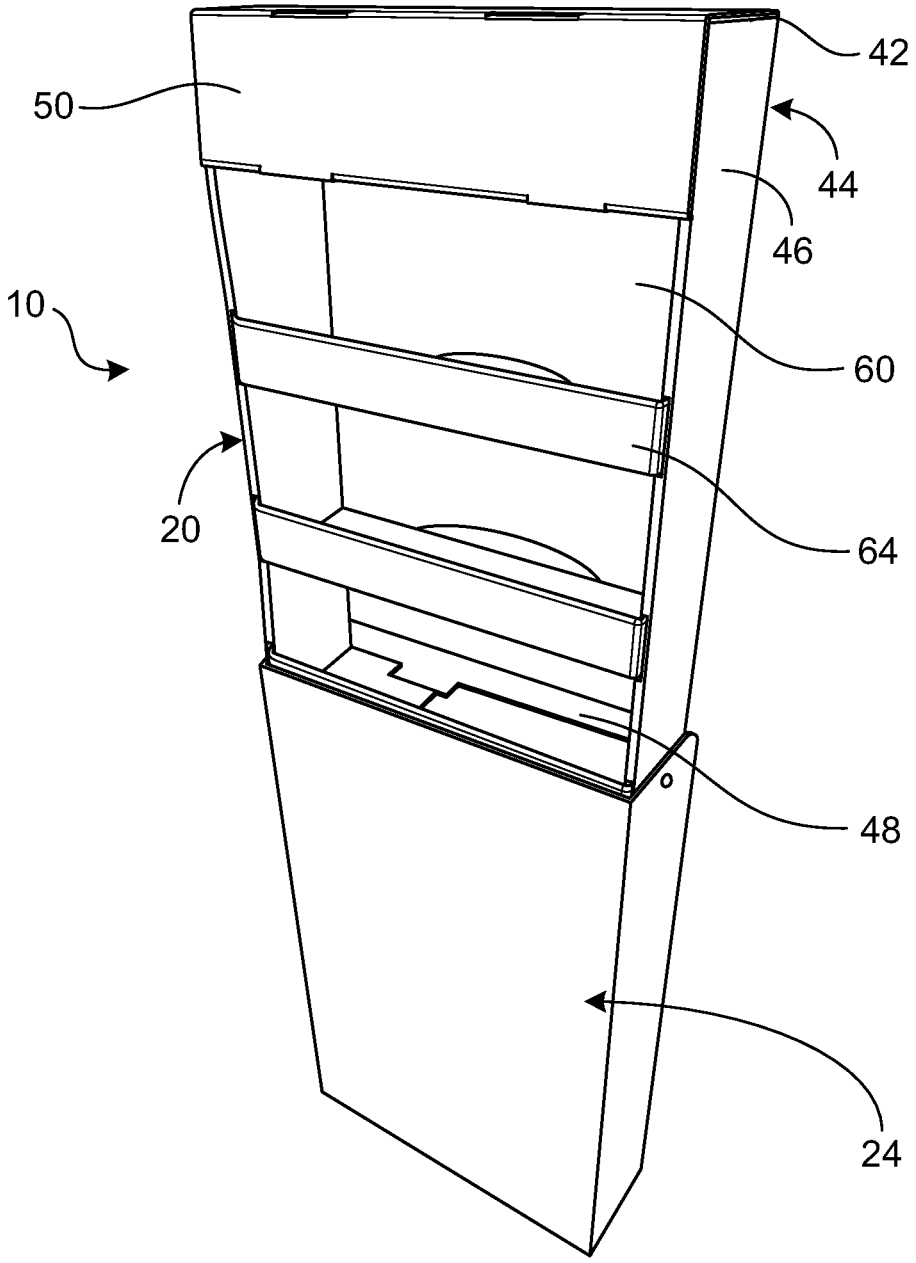
FIG. 2 is a perspective view of a display in a deployed condition.

FIGS. 1-5 show a display 10 for use in the sale of items in a retail sales environment, for example. FIG. 1 shows the display 10 in a stowed condition, and FIG. 2 shows the display 10 in a deployed condition. The stowed condition is used during shipment and storage of the display. When in the stowed condition, the blanks that make up the display are disposed in a nested configuration—blank 22 is in contact with blank 26. The display when in a stowed condition utilizes less volume and surface area than when the display is in the deployed condition. In the deployed condition, the display provides a first portion 12 for holding and displaying packaged products for sale (products not shown). The display 10 provides a second portion 14 for displaying graphic and textual subject matter to provide information such as, e.g., the product name, a description of the product, the price, and why you should buy it. The graphic and textual matter can be printed onto the display or applied in stickers or other fashion that is well known to those of ordinary skill in the art.

FIGS. 1 and 2 show the display 10 has a plurality of rectangular display compartments 60 vertically spaced from one another and extending in parallel spaced relationship with one another between the opposed side walls 46. Three such rectangular display compartments 60 are shown but fewer or greater number can be provided based upon the product display size and shape. It is contemplated any number of display compartments 60 could be provided from 1 to 100, but more likely would be from two to 24, and most preferably from two to 12. Two shelves 64 are shown in the display, although a single shelf 64 could be used or more than two shelves 64 could also be used.

Figure 3:
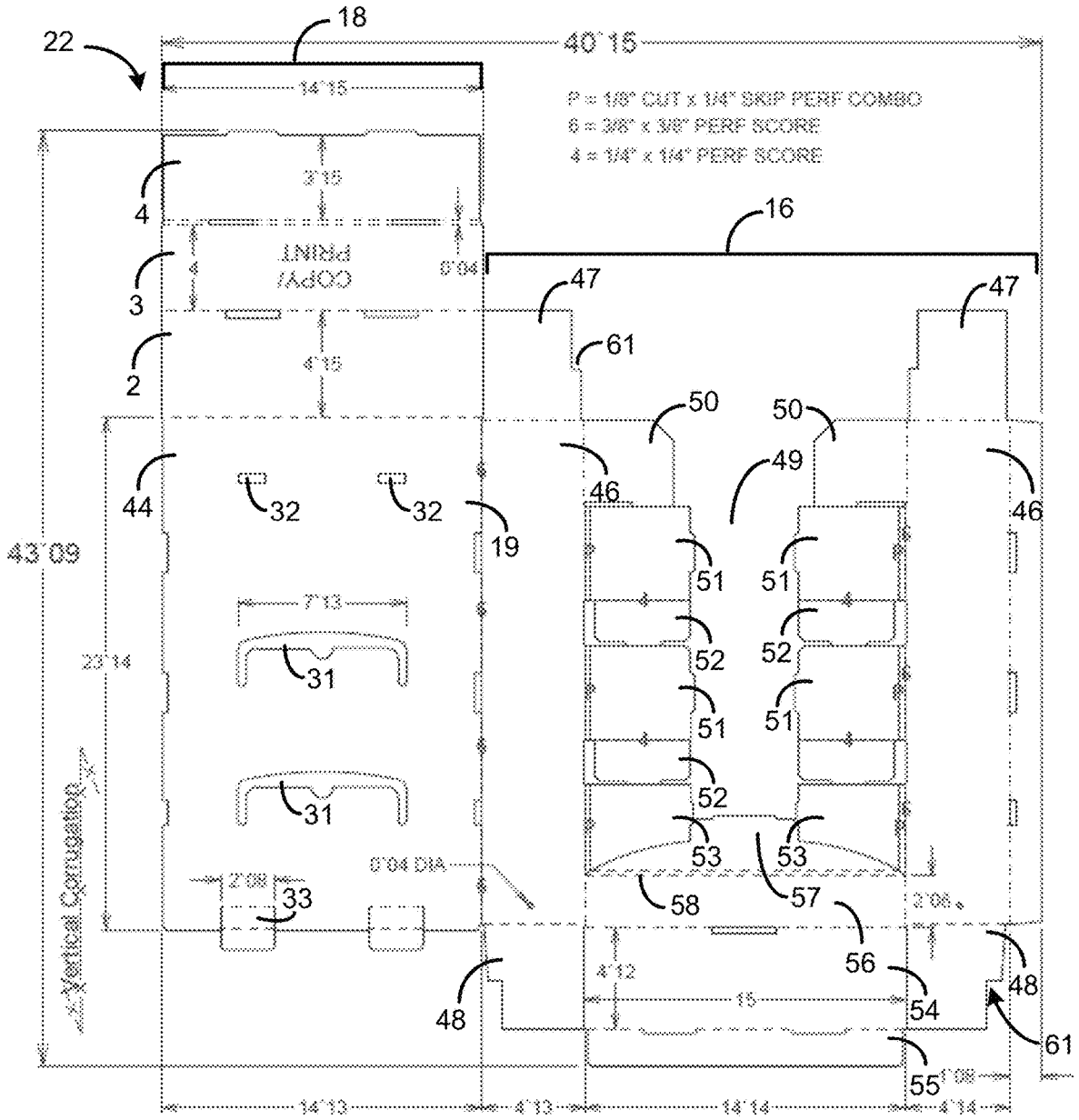
FIG. 3 is a plan view of a blank for forming a portion of the display of FIG. 1.

The display 10 has a rectangular sleeve 20 folded from a first blank of material 22 shown in FIG. 3. The display 10 has a graphics extension panel 24 folded from a second blank 26 shown in FIG. 4. The display 10 also has two shelves 64 each individually folded from a third blank 30 of FIG. 5. The graphics extension panel 24 is hingedly connected to the rectangular sleeve 20 with a tab such as 178 in FIG. 13.13 from one of the parts engaging a slot such as 180 in FIG. 13.13 from another of the parts (See FIGS. 13.11-13.14) or using an adjust-a-lok fastener 11 of FIG. 7 as will be described below with reference to FIGS. 21.1-21.27. When in the stowed condition a height dimension of the assembly is shorter than when in the deployed condition. A height dimension of the display in the deployed condition is from 1.5 to 2.5 times larger than when in the stowed condition.

FIG. 3 shows the blank 22 having a first wing 16 and a second wing 18 connected together along a fold line 19. Each of the first wing 16 and the second wing 18 have multiple panels. The first wing 16 has two opposed side wall panels 46 each terminating at opposed ends with a top tab 47 and a bottom tab 48. A portion of an inner lateral edge of the top tab and bottom tab is removed to form a notch 61. On an inner lateral edge of each side panel 46 extends a segmented shelf support panel. A cutout 49 separates inner edges of the side wall panels 46, and when the display is in a deployed condition, the cutout 49 forms an opening or access to the rectangular display compartments 60. Each segmented side panel has a head flange 50, a tail flange 53, and two shelf support flaps 51 adjacent two gaps 52. The gaps 52 and support flaps 51 are to receive and support opposed ends of a shelf 64 folded from a blank 30 of FIG. 5, which shall be described below.

The first wing 16 also has a front panel 56, a bottom panel 54, a tab 55, and a bottom wall panel 57 connected by a fold line 58 to a top edge of the front panel 56. These when deployed will form a bottom portion of the rectangular sleeve.

The second wing 18 of the blank 22 (FIG. 3) has a back wall 44 with two C-shaped cutouts 31 spaced vertically from one another, and two square cutouts 32 horizontally spaced from one another and proximate a top edge of the back panel 44. The back wall has a pair of tabs 33 spaced along a bottom edge of the back wall 44. The second wing also has a top panel 2, a header panel 3, for supporting graphical and textual material, and a cover panel 4 that serves to hide the hollow chamber behind the header panel.

Figure 4:
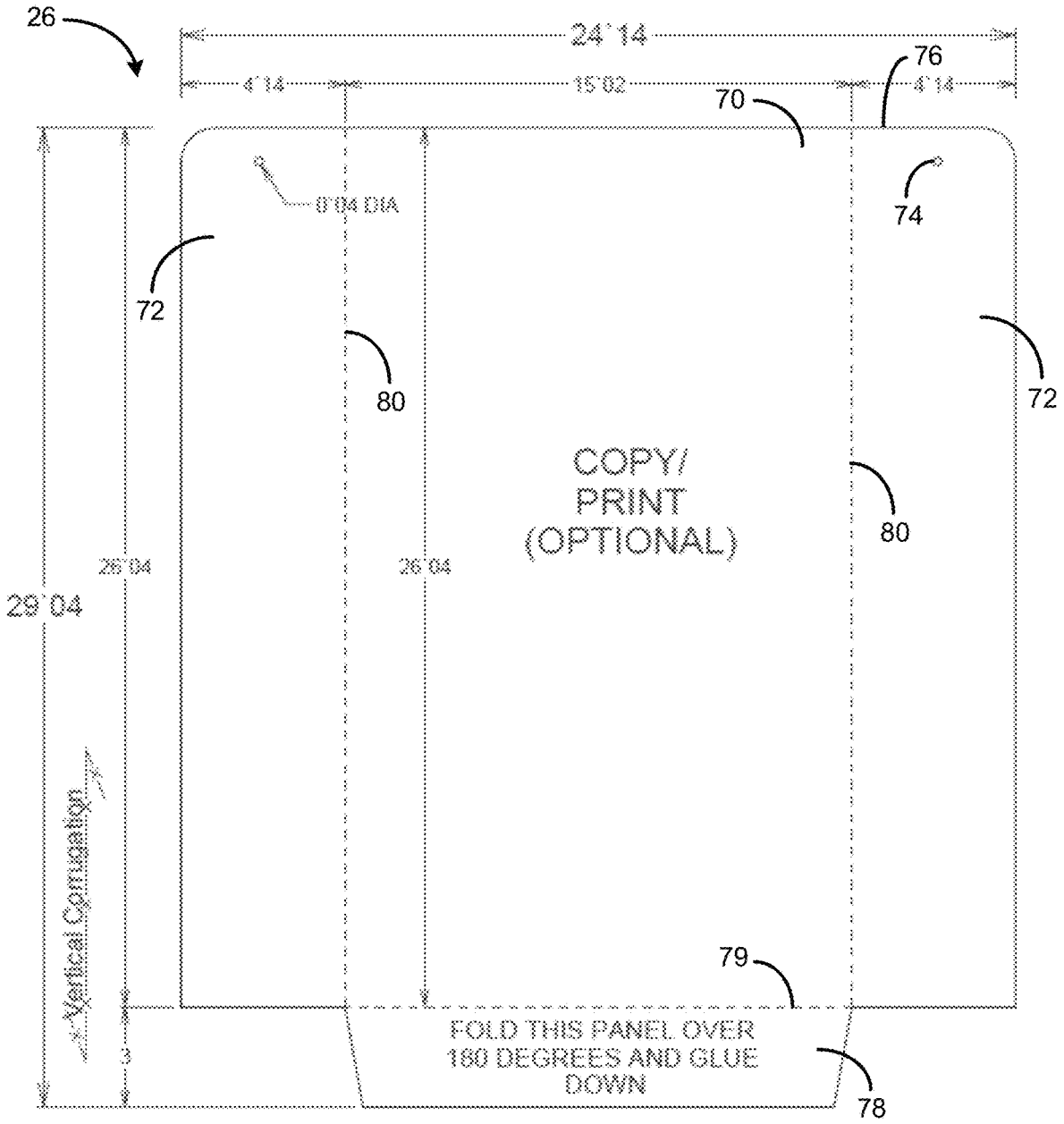
FIG. 4 is a plan view of a blank for forming a graphics extension panel of FIG. 1.

FIG. 4 shows the blank 26 for forming the graphics extension panel has a front panel 70 flanked by two side panels 72 opposed to one another. A hole 74 is provided on each of the two side panels 72 proximate a top end 76. As shown in FIG. 21.11, the hole 74 is placed in alignment with a hole 75 in the side wall 46. A male fastener is inserted through the aligned holes from one side, and a female fastener 76 is inserted into the aligned holes from the opposite side. Threads in the male fastener are mated with threads on the female fastener to releasably, and hingedly attach the graphics extension panel 24 to the rectangular sleeve 20. A bottom tab 78 extends from a bottom end 79 of the front panel. To erect the panel extension 26, the side panels 72 are folded along fold lines 80 to be orthogonal to the front panel 70 and the bottom tab 78 is folded along fold line 79 180°, and an outer planar surface of the tab is attached to an inner planar surface of the front panel 70 by an adhesive to create rigidity in the panel to prevent false scoring.

Figure 5:
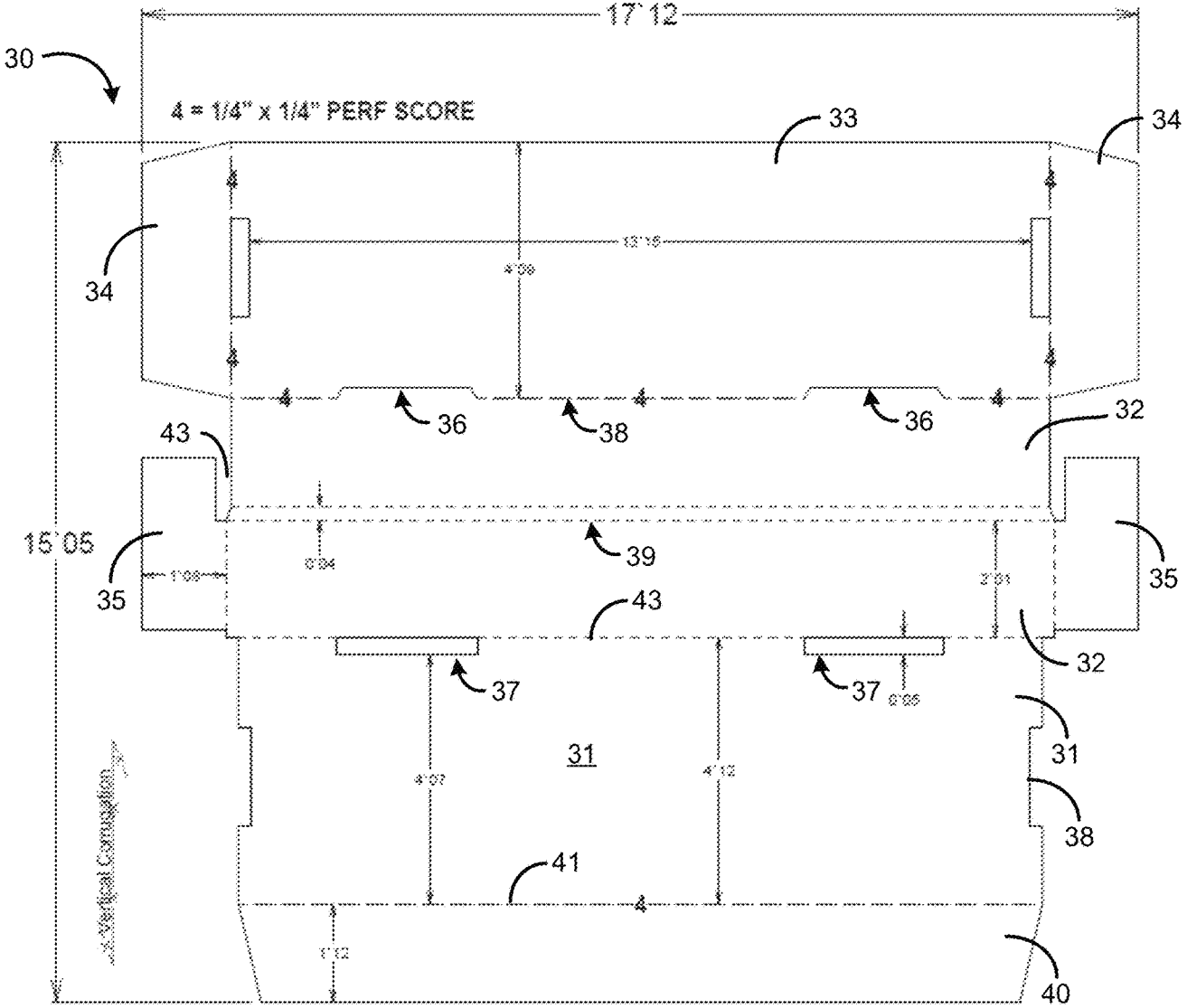
FIG. 5 is a plan view of a blank for forming a shelf in the display of FIG. 1.
Figure 6:
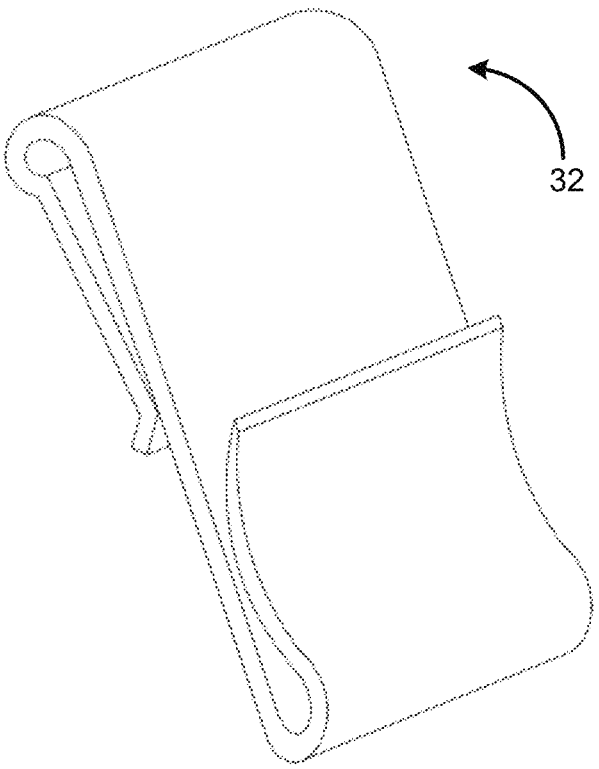
FIG. 6 is a perspective view of a U-shaped clip used in the display of FIG. 1.

Now for a description of a shelf 64. As best seen in FIGS. 5 and 21.12-21.17, the shelf 64 is deployed from a blank 30. The blank 30 has a first base panel 31, a second base panel 33, two back panels 32. A first pair of side panels 34 extend from opposed lateral edges of the second base panel 33. A second pair of side panels 35 extend from opposed lateral edges of one of the back panels 32. A portion of the side panels 35 is removed to form a gap 43, or a slot 43, respectively of when the display is in the stowed condition or the deployed condition. The blank 30 also has a pair of tabs 36 on a proximal edge of the second base panel 33, and a pair of slots 37 on a proximal edge of the first base panel 31. The blank has a first fold line 38 and a second fold line 39 extending in parallel spaced relationship. The blank also has tab 40 extending from a distal edge of the first side panel 31 along a hinge 41.

One preferred sequence of folding the blank 30 is shown in FIGS. 21.12-21.17. First the side panels 34 and 35 are folded at 900 into the form of a C-shaped body, and the blank 30 is folded along fold line 38 90° placing the first and second back panels 32, the first base panel 31, and the tab 40 in a first plane perpendicular to a second plane extending through the second base panel 33 (FIG. 21.13) to define an L-shaped body. With reference to FIG. 5, one has to imagine the tab 40, the first base panel 31, etc., are coming out of the paper at a 90° angle and the second base panel 33 is in the plane of the paper. Now the L-shaped body of FIG. 21.13 is folded along line 41 to form a Z-shaped body in FIG. 21.14. The blank 30 is then folded along line 39 such that the back panels are folded upon themselves to form a double thickness back wall 44. The first base panel 31 is folded on top of the second base panel 33 to form a double thickness base wall. The tab 40 is folded down 90° (FIG. 21.16) between the side panels 34. The shelf 64 is now ready for use in the rectangular sleeve as will now be described.

FIGS. 21.18-21.27 show the sequence of incorporating a shelf 64 into the rectangular compartments 60 and the process will be repeated for additional shelves. The shelf 64 is aligned with the gaps 52 and slid into the compartment. A portion of the back panel 32 is inserted through the slot 31 in the back wall 44 to support the shelf as is shown in FIG. 21.20. The shelf support flaps 51 are folded downward and inward 270° into contact with an inner surface of the side wall 46 and the side panels 35 are folded inward to support the shelf 64 as is shown in FIGS. 21.22-21.24. The bottom wall is then folded as shown to complete the rectangular sleeve portion of the display.

FIGS. 8-12 show an alternative display 100 much the same as shown in FIGS. 1-5 but with some differences. The display 100 has a rectangular sleeve 102 folded from a first blank 104 of FIG. 9, and a graphic extension panel 124 folded from a second blank 106 of FIG. 12. The graphic extension panel 124 is connected to the rectangular sleeve with tabs on the graphic panel engaging slots in the rectangular sleeve and without the use of the fasteners shown above. (See FIGS. 13.13 and 13.14) However, the adjust-a-lok fastener could also be used. Two rectangular display compartments 160 extend in parallel spaced relationship between the opposed side walls 146.

Figure 9:
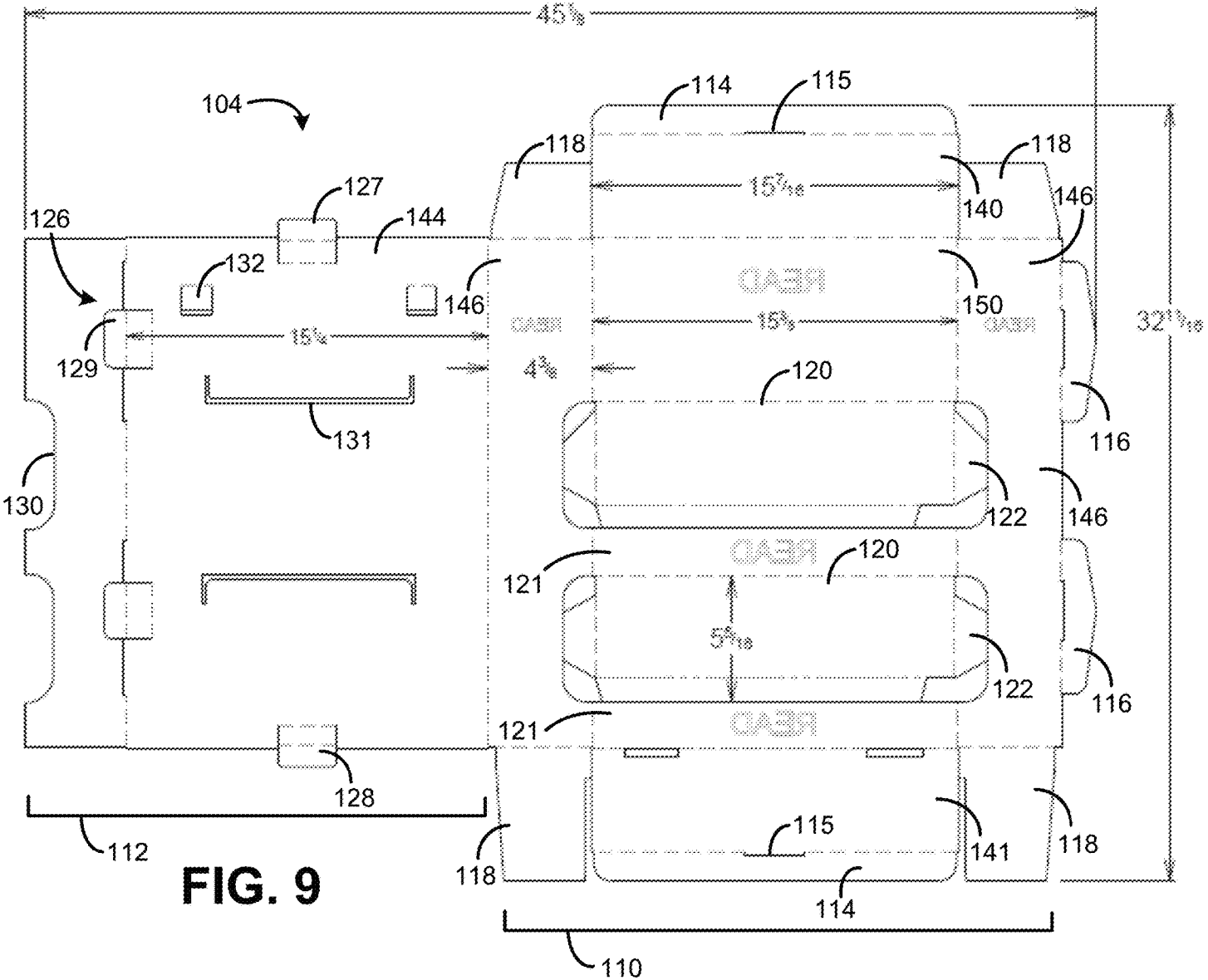
FIG. 9 is a plan view of a blank for forming a portion of the display of FIG. 8.

FIG. 9 shows the blank 104 which can be folded by a hand of a user of the display (as is set forth in detail in FIGS. 13.1-13.28 and described below) for forming the rectangular sleeve 102. The blank 104 has a first wing 110 hingedly connected to a second wing 112. Each wing 110,112 has several panels. The first wing 110 has a top panel 140 at one end of the blank, and a bottom panel 141 at an opposed end of the blank 104. A pair of opposed side panels 146 extend from lateral edges of the first wing 110. Both the top panel and bottom panel 140,141 terminate at a distal end in a tab 114 connected by a hinge. At a central point of the tab 114, on a proximal edge thereof, is a combination tab/slot 115. One of the side walls 146, the one on the right in FIG. 13.1, has two combination tab and slots 116 spaced along a leading edge of the side wall 146. Each opposed top and bottom end of the side walls terminate respectively in a top tab or a bottom tab 118 separated by a hinge.

A top header panel 150 is connected to the top panel 140 along a hinge. Two shelf panels 120 extend in parallel spaced relationship between the opposed side walls 146 and terminate at opposed ends with a combination of a lateral shelf tab 122 and lateral shelf tab slot 124. A vertical surface 121 is associated with each shelf panel 120 and can serve as a lip to hold products in the display, and as a surface to support graphical and textual subject matter. In FIGS. 13.1 and 13.2, during folding of the blank 104, the lateral shelf tab 122 remains in the same plane as the shelf panel, but the lateral shelf tab slot 124 moves with the side wall 146 to a position perpendicular thereto, and the lateral shelf tab 122 is inserted into the lateral shelf tab slot 124 to retain the side wall 146 perpendicular to the back wall.

The second wing 112 has a back panel 144, an inside side wall 126, a combination top tab and slot 127, a combination bottom tab and slot 128, and two side tab and slot combinations 129 spaced from one another along a lateral edge of the second wing 112. On a leading edge of the inside side wall panel 126 has two cutouts 130 spaced from one another. The back panel 144 has two C-shaped cutouts 131 spaced vertically from one another and two square cutouts 132 horizontally spaced from one another and proximate a top edge of the second wing 112.

Figure 12:
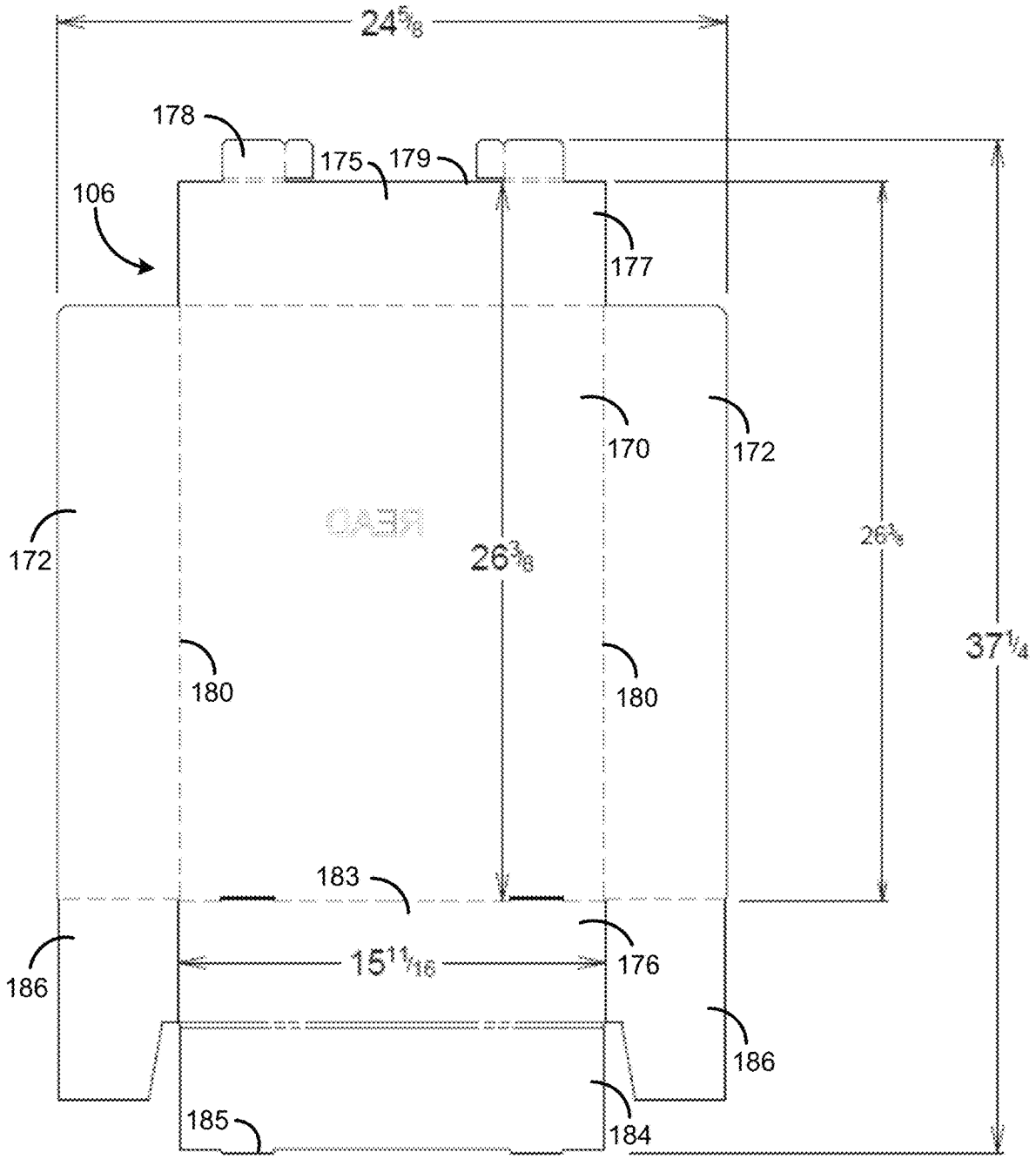
FIG. 12 is a plan view of a blank for forming a graphics extension panel of FIG. 8.

The graphics extension panel is folded from the blank 106 shown in FIG. 12 and FIGS. 13.9-13.12. The blank 106 has a front panel 170, opposed side panels 172, a top flap 175, and a bottom flap 176. The top flap 175 has a flap panel 177 and two tabs 178 horizontally spaced from one another and attached to a leading edge 179 of the flap panel 177. The tabs 178 are segmented. The bottom flap 176 has a panel 183, a tab 184 extending from the panel 183 and having two, horizontally spaced flanges 185. The bottom flap 176 also has two side tabs 186 extending from lateral edges of the panel 183.

Figure 10:
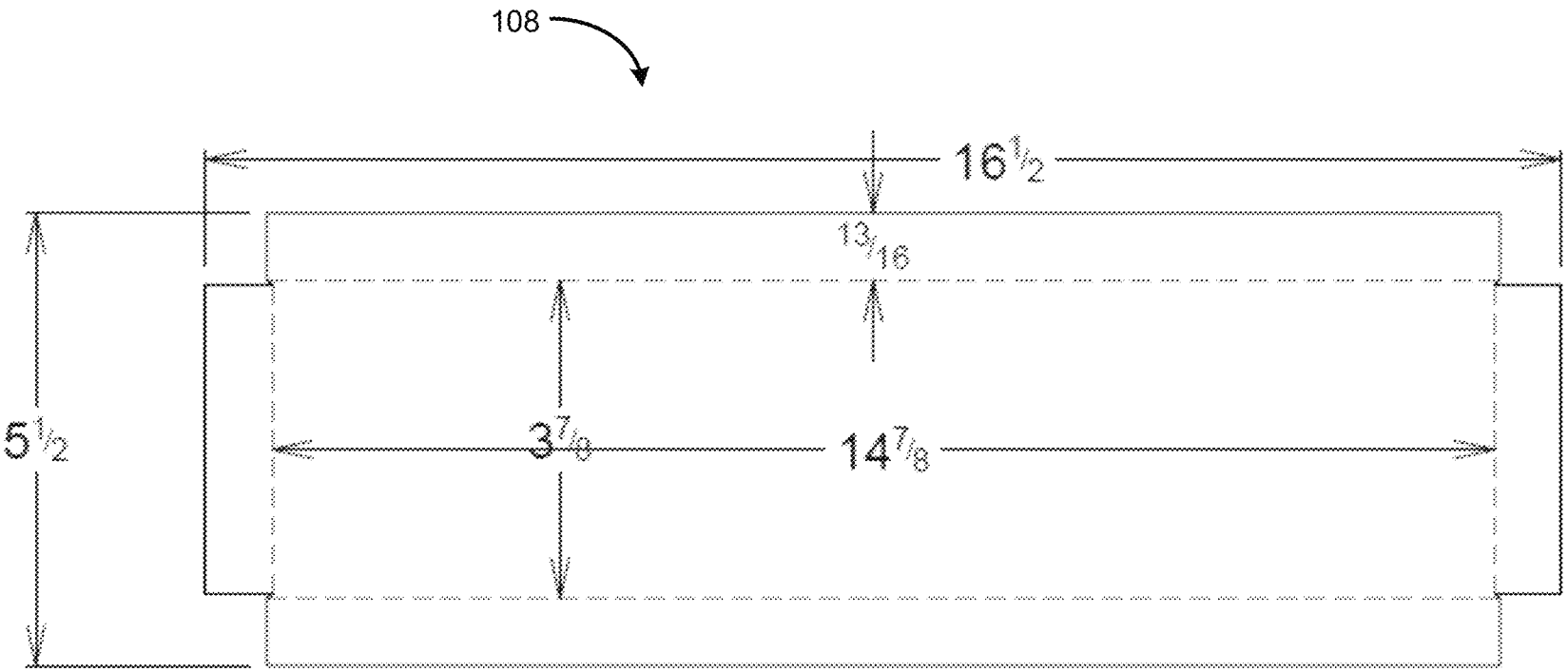
FIG. 10 is a plan view of a blank for forming a platform of the display of FIG. 8.

An optional platform can be placed on top of the shelves 120 or the shelves 64 in FIG. 2 to support products a little higher in the rectangular compartments and is folded from a blank 108 shown in FIGS. 10, 13.15, and 13.16. The folded platform is placed directly on top of the shelves 120 or the shelves 64 in FIG. 2.

Figure 8:
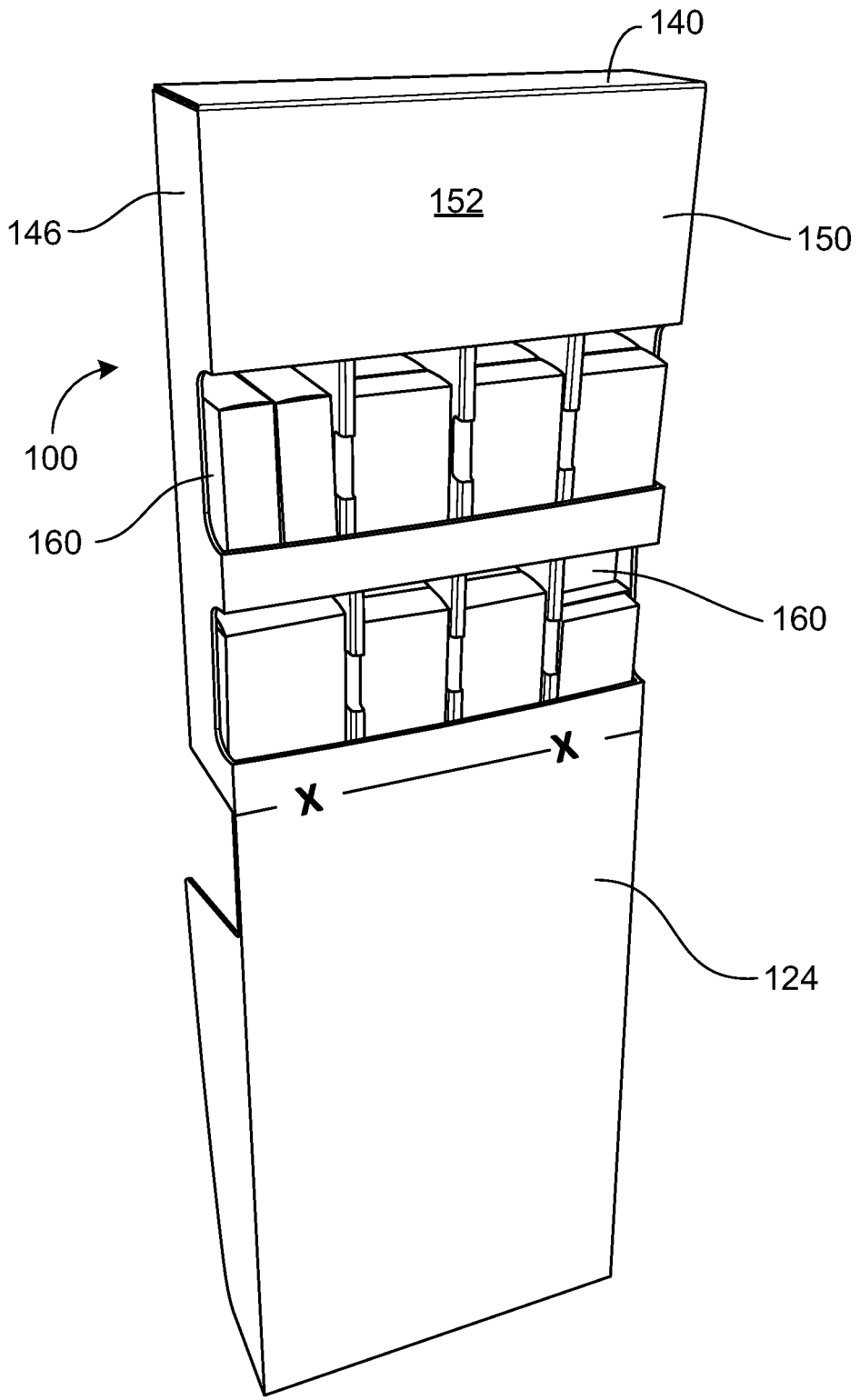
FIG. 8 is a perspective view of an alternative display in a stowed condition.
Figure 11:
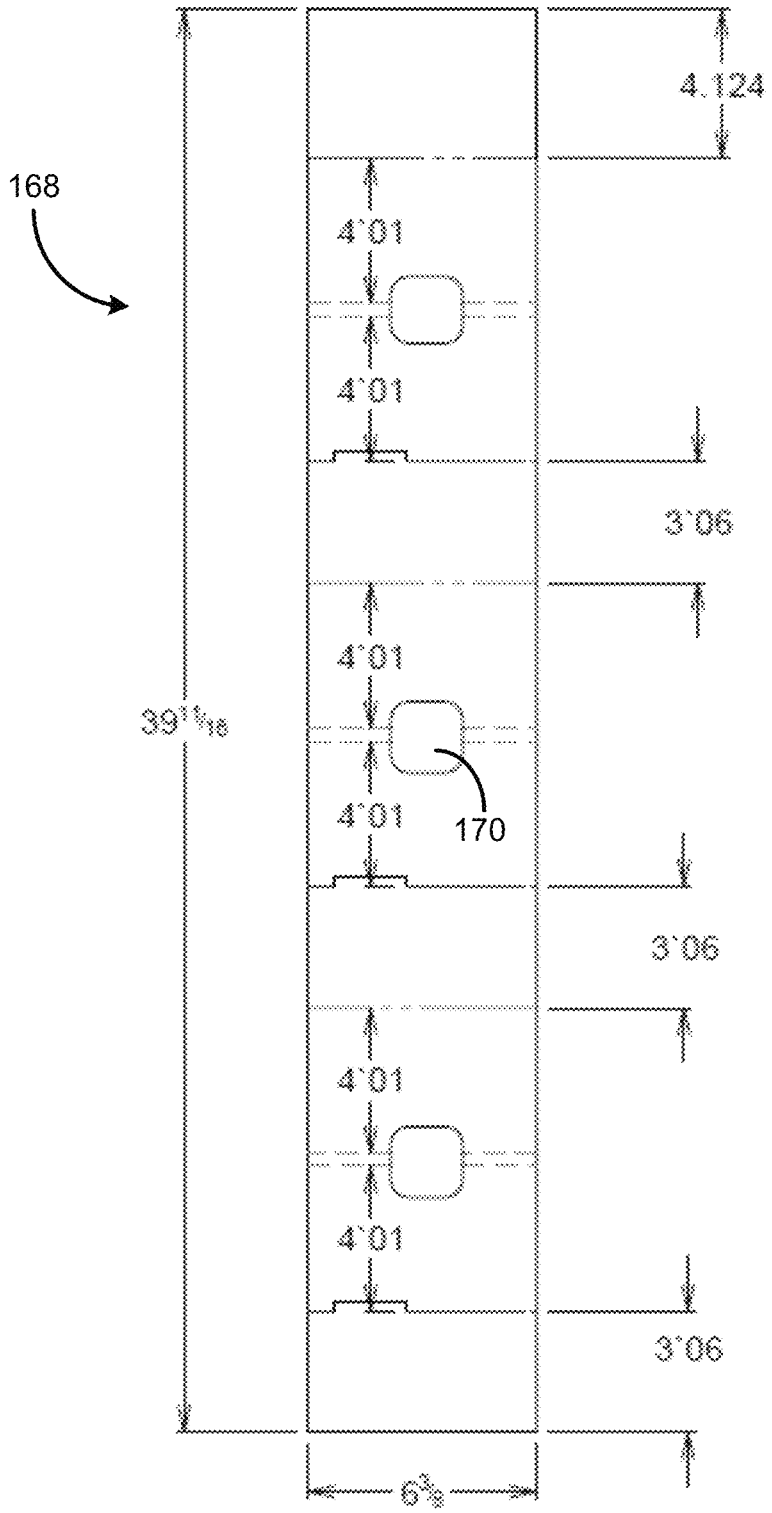
FIG. 11 is a plan view of a blank for forming a divider in the display of FIG. 8.

FIG. 11 shows a blank 168 for forming a divider. Each of the rectangular display compartments 160 shown in FIG. 8 are further divided into four sub-chambers 165 by a divider 166 folded from the blank 168 of FIG. 11 and as shown in FIGS. 13.17 and 13.18. A front edge of the divider 166 has a portion removed 170 to provide access to the products by a consumer or user of the display. Two such rectangular display compartments 160 are shown with eight sub-chambers but fewer or greater number of compartments or sub-chambers 165 can be provided based upon the product display size and shape. It is contemplated any number of display compartments 160 and sub-chambers 165 could be provided from 1 to 100, but more likely would be from two to 24, and most preferably from two to 12. The divider 166 can also be placed in the display compartments shown in FIG. 1.

FIGS. 13.19A-D-13.21 show an optional BR filler 190 which is essentially a rectangular shaped box that is inserted into a subchamber to fill space.

FIGS. 13.1-13.8 show the folding of the blank 104 into the rectangular sleeve 102. The blank 104 is placed flat on a surface and the second wing 112 is folded toward the first wing until the side wall 146 is perpendicular to the second wing and the back panel 144 is folded an additional 90° to be in a parallel plane to the second wing and vertically spaced therefrom. The inside side wall 126 is folded an additional 90° until a leading edge of the inside side wall 126 is in contact with the back wall. (FIG. 13.2) The other side wall 146 is folded 90° from the back wall and is in face-to-face contact with the inside side wall 126 to form a sidewall with double thickness. (FIG. 13.3) The tabs are folded as indicated to form the rectangular sleeve 102 secured together to prevent unfolding as is shown in FIGS. 13.4-13.6. The shelves are then folded into position as shown in FIGS. 13.7 and 13.8 and a portion of each shelf extends through the C-shaped slot 131 of the back wall 144 to support the shelf. This completes the assembly of the rectangular sleeve 102.

The graphics panel extension 124 is folded from the blank 106 into a rectangular body and the tabs 178 are inserted into slots 180 of the rectangular sleeve to hingedly connect the two parts as is shown in FIGS. 13.13 and 13.14. When in the deployed condition, the graphics panel extension 124 extends from the rectangular sleeve 102. (FIG. 13.13) When in the stowed condition, the graphics panel extension 124 is folded upward so that a panel 184 of the graphics panel extension 124 is in contact with a bottom surface of the rectangular sleeve 102 and the rectangular compartment encompasses the side walls and the back wall. When in the stowed condition a height dimension of the assembly is shorter than when in the deployed condition. A height dimension of the display in the deployed condition is from 1.5 to 2.5 times larger than when in the stowed condition.

Figure 14:
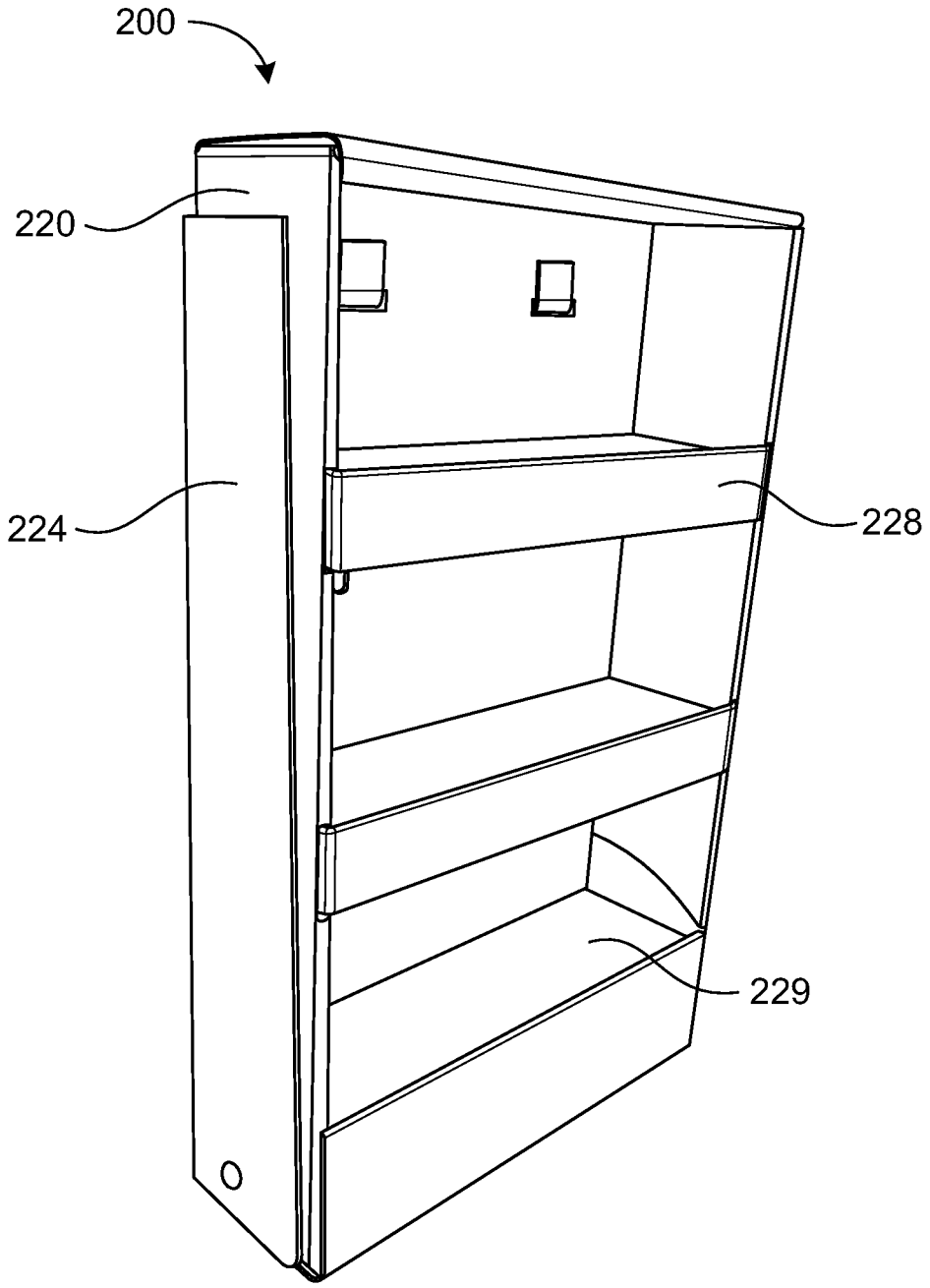
FIG. 14 is a perspective view of an alternative display in a stowed condition.
Figure 15:
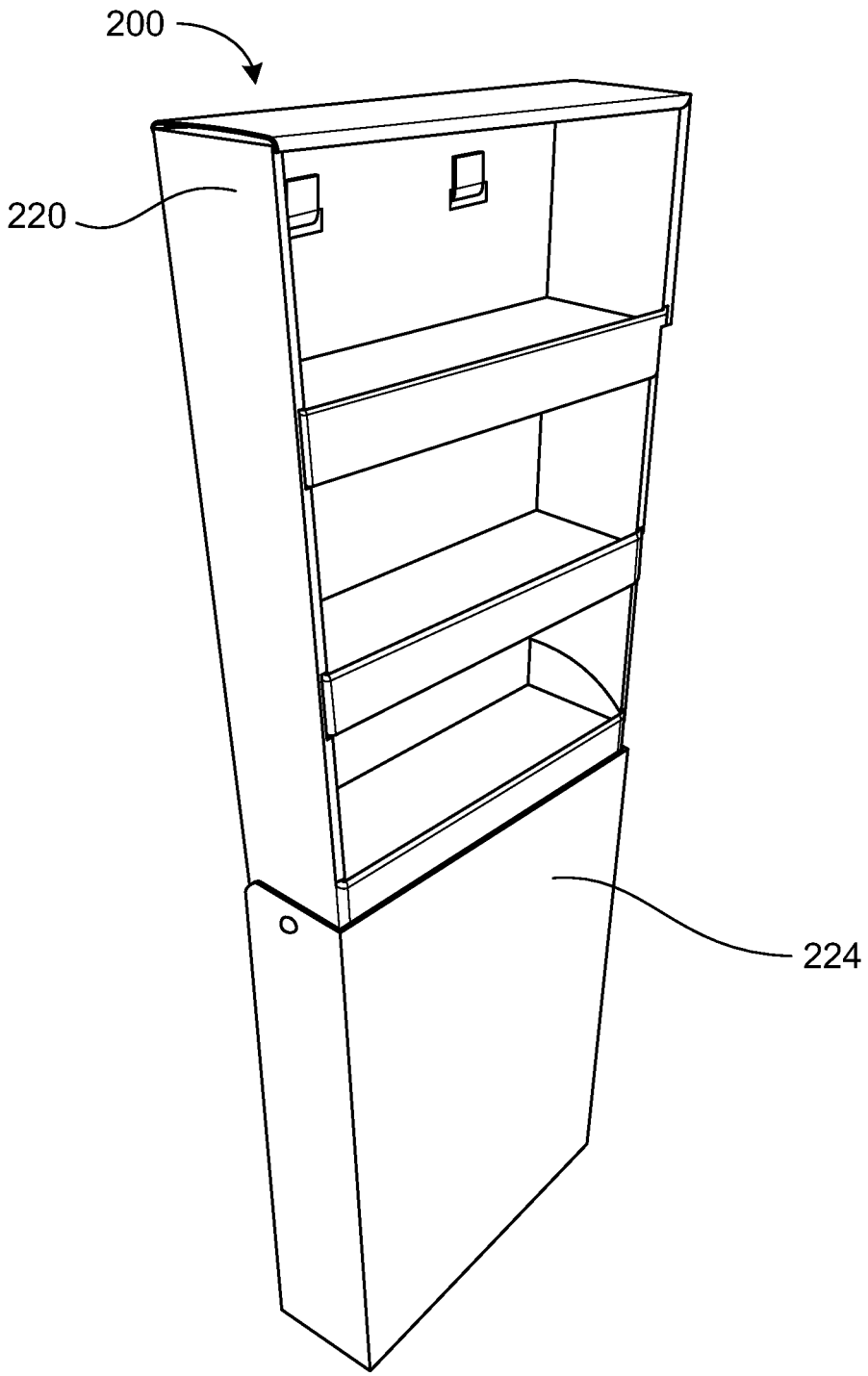
FIG. 15 is a perspective view of an alternative display in a deployed condition.
Figure 24:
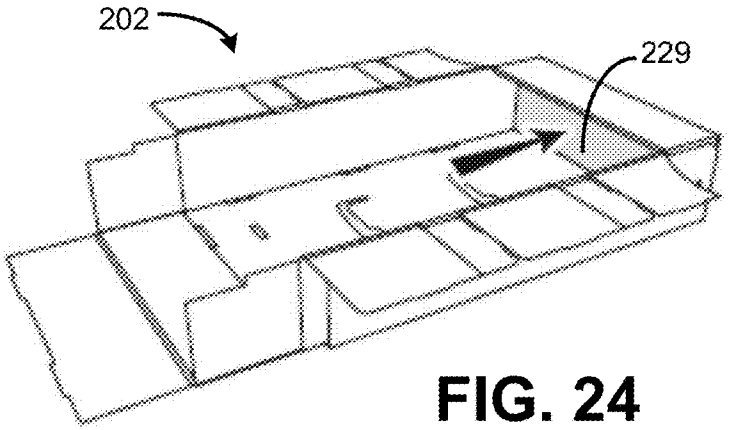
FIGS. 22-24 illustrate the steps for folding a false bottom and incorporating it into the display.

FIGS. 14-20 show an alternative display 200 of the present invention in the stowed condition in FIG. 14 and in a deployed condition in FIG. 15. The display 200 has a rectangular sleeve 220 folded from a first blank of material 222 shown in FIG. 16. The display 200 has a graphics extension panel 224 folded from a second blank 226 shown in FIG. 19. The display 200 also has two shelves 228 each individually folded from a third blank 230 of FIG. 17. The display also has and a false bottom 229 as shown in FIG. 24. The graphics extension panel 224 is hingedly connected to the rectangular sleeve 220 with an adjust-a-lok fastener 11 of FIG. 7 as will be described below.

Figure 16:
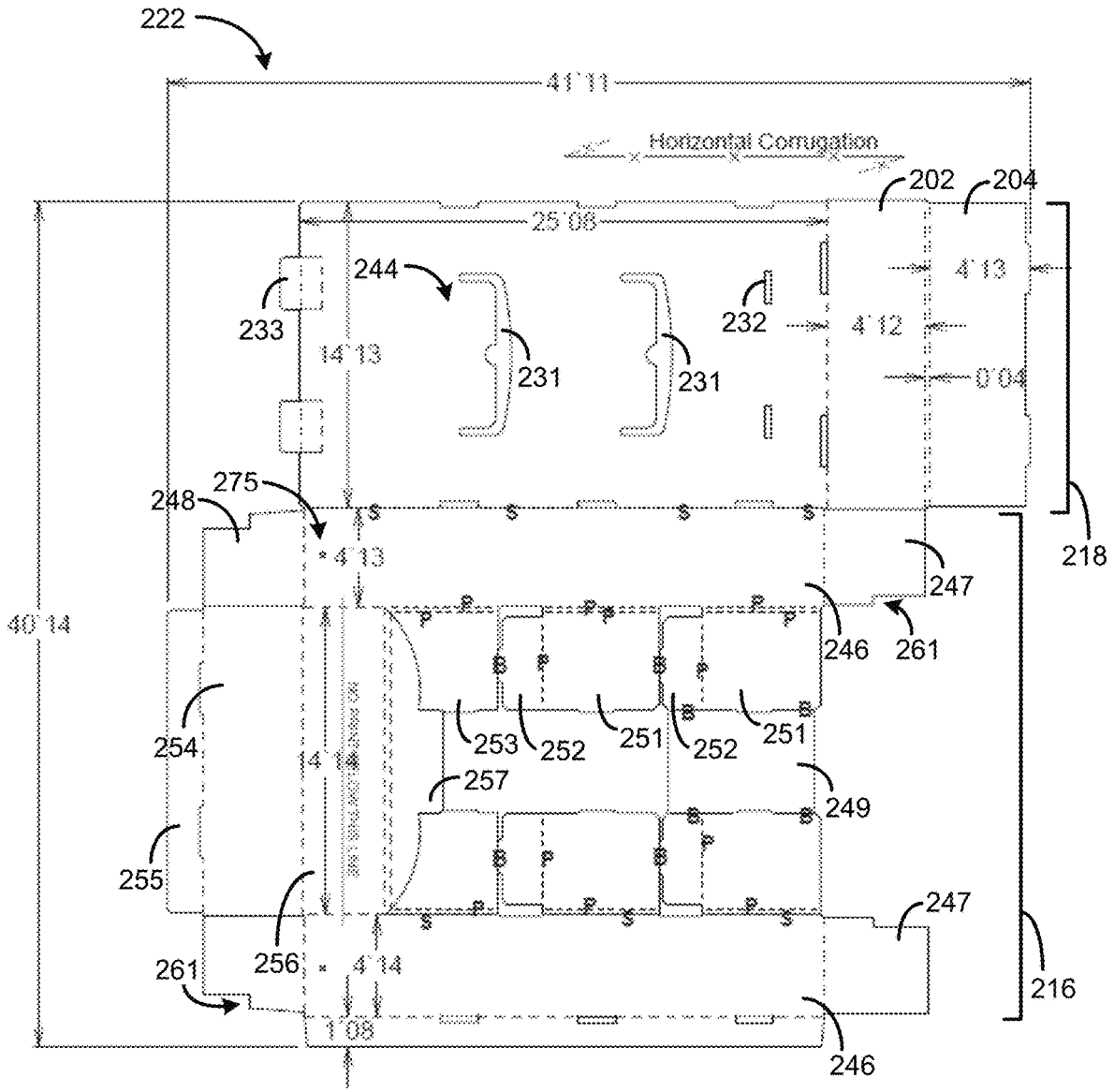
FIG. 16 is a plan view of a blank for forming a portion of the display of FIG. 14.
Figure 17:
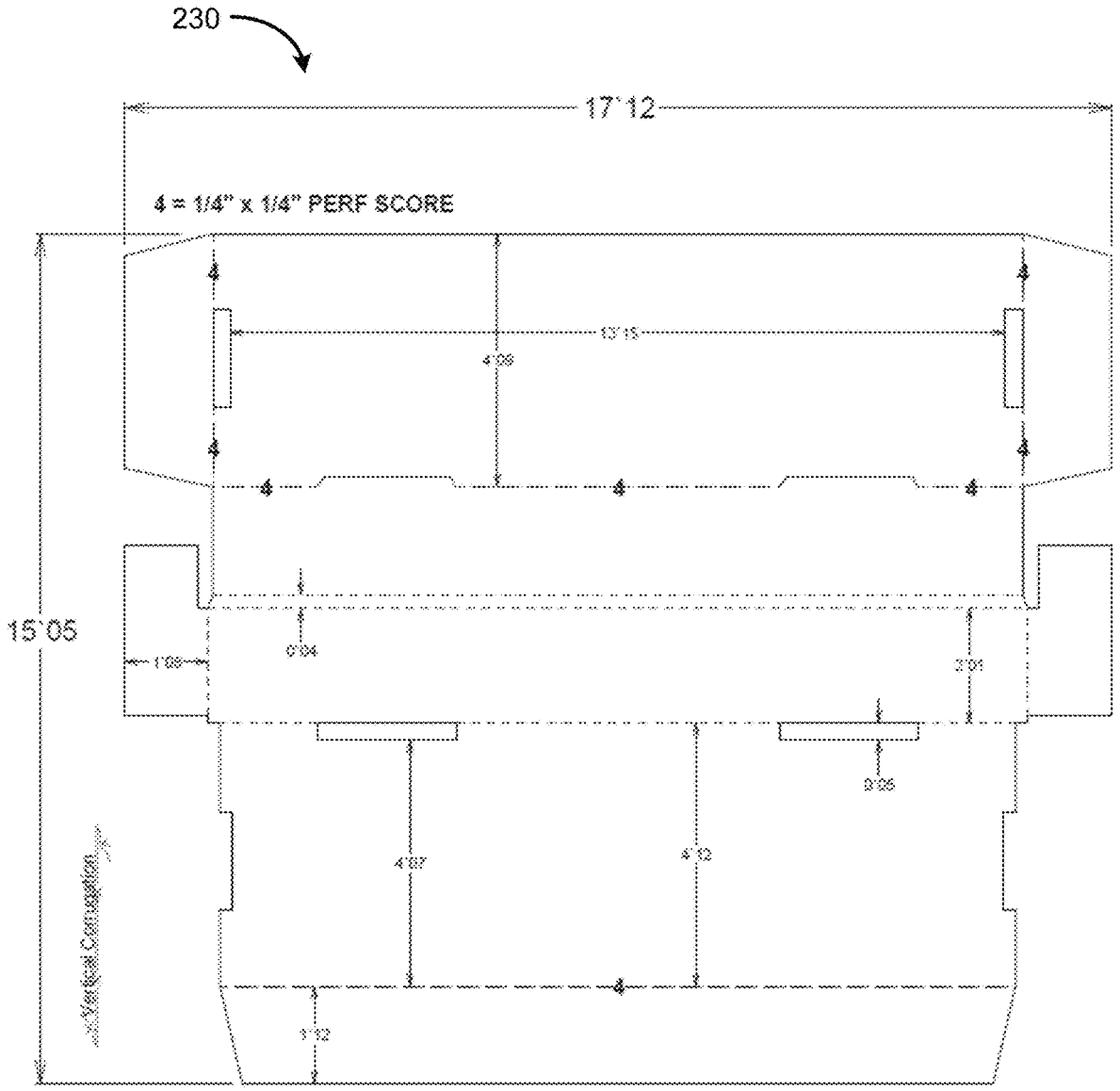
FIG. 17 is a plan view of a blank for forming a shelf of the display of FIG. 14.
Figure 18:
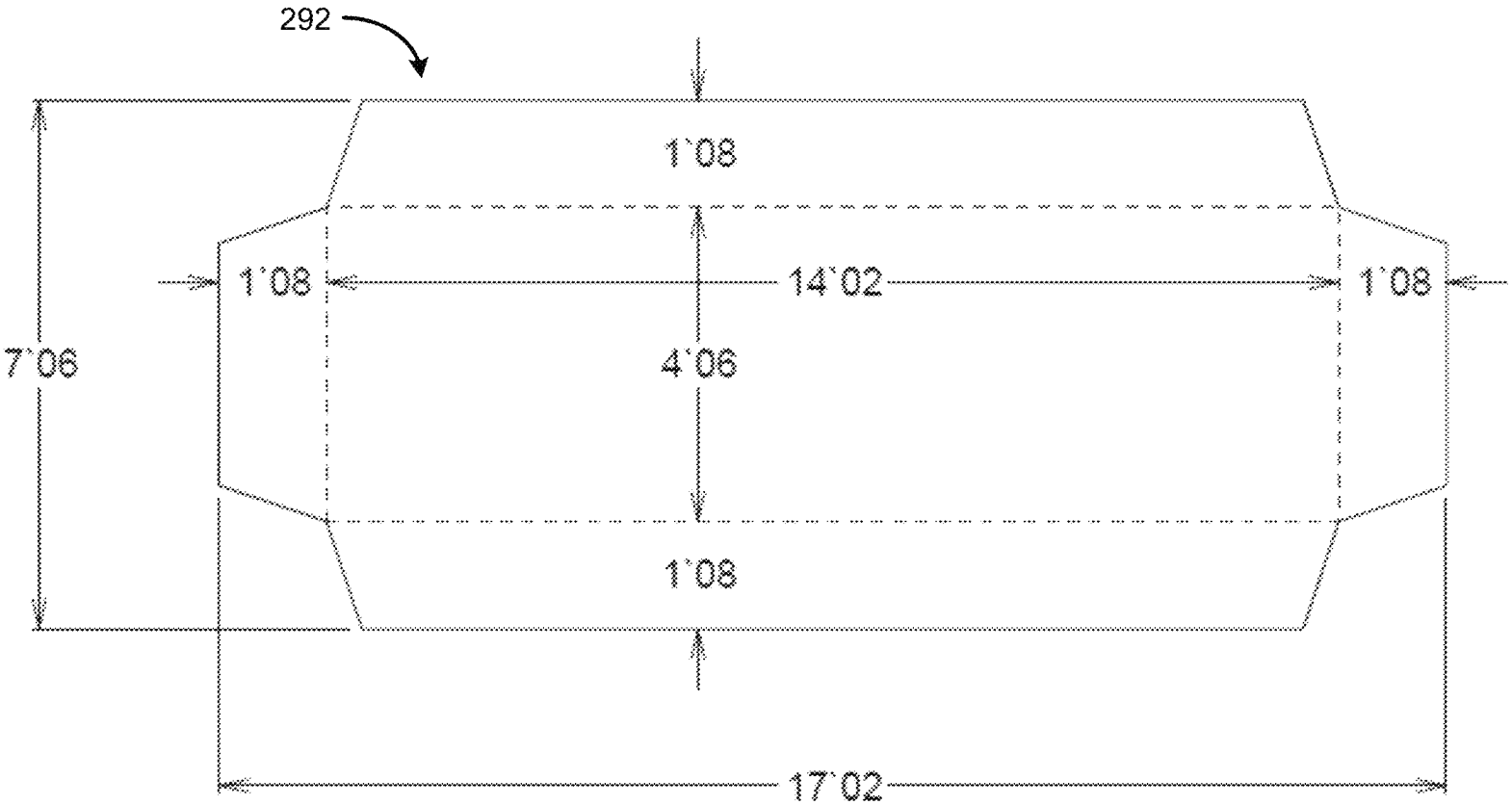
FIG. 18 is a plan view of a blank for forming a riser of the display of FIG. 14.

FIG. 16 shows the blank 222 having a first wing 216 and a second wing 218 connected together along a fold line. Each of the first wing 216 and the second wing 218 have multiple panels. The first wing 216 has two opposed side panels 246 each terminating at opposed ends with a top tab and a bottom tab 248. A portion of an inner lateral edge of the top tab and the bottom tab is removed to form a notch 261. A segmented support panel extends from an inner lateral edge of the side panel 246. A cutout 249 separates inner edges of the segmented support panels, and when the display is in a deployed condition, the cutout 249 forms an opening or access to the rectangular display compartments. Each segmented support panel 247 has a head flange, a tail flange 253, and two shelf support flaps 251 and two gaps 252 alternating along a vertical dimension of the display. The gaps 252 and support flaps 251 are to receive and support opposed ends of a shelf or a false bottom 229 folded from a blank 281 of FIG. 20, which shall be described below.

The first wing 216 also has a front panel 256, a bottom panel 254, a tab 255, and a bottom wall panel 257 connected by a fold line to a top edge of the front panel 256. These panels when deployed will form a bottom portion of the rectangular sleeve.

The second wing 218 of the blank 222 (FIG. 16) has a back wall 244 with two C-shaped cutouts 231 spaced vertically from one another. The back wall also has two square cutouts 232 horizontally spaced from one another and proximate a top edge of the back panel 244. The back wall has a pair of tabs 233 spaced along a bottom edge of the back wall 244. A top panel 202 and a header panel 204, much reduced in vertical dimension when compared to the header panel 3 of FIG. 3. A false bottom 229 is used in the display above and is folded from the blank 281 of FIG. 20.

Figure 7:
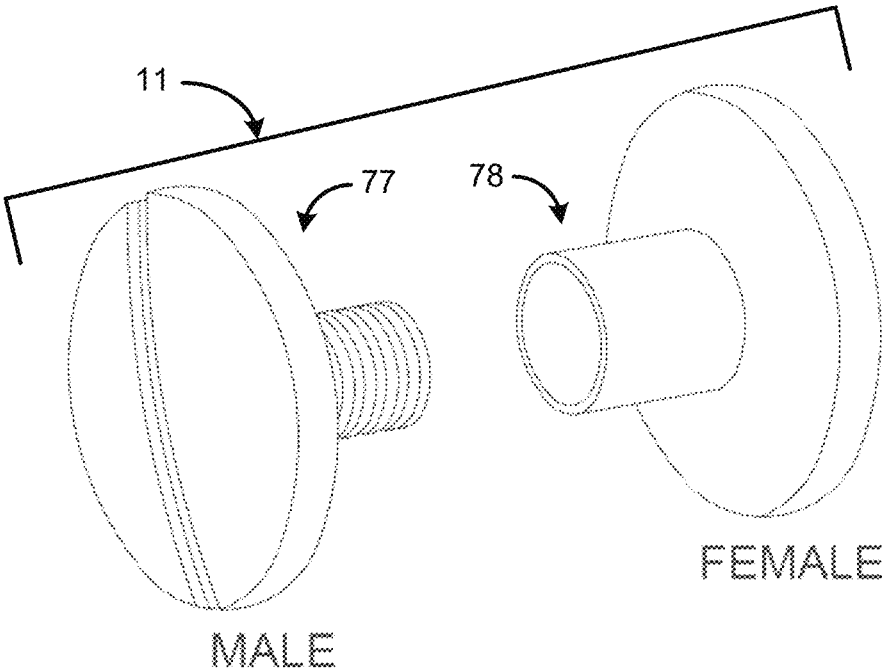
FIG. 7 is a perspective view of an adjust-a-lok fastener system used in the display of FIG. 1.
Figure 19:
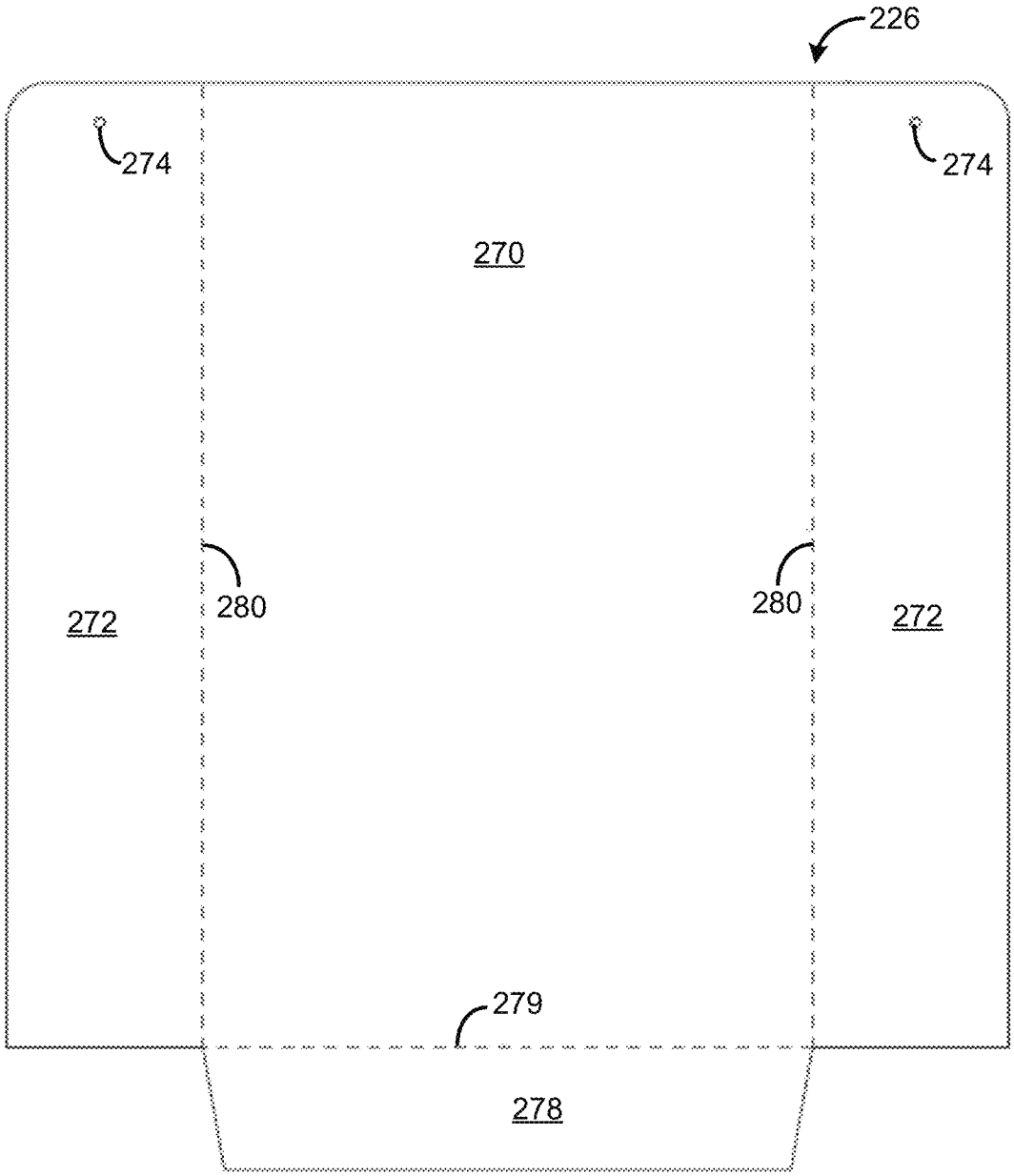
FIG. 19 is a plan view of a blank for forming a graphics extension panel of FIG. 14.

FIG. 19 shows the blank 226 for forming the graphics extension panel has a front panel 270 flanked by two side panels 272 opposed to one another. A hole 274 is provided on each of the two side panels 272 proximate a top end. Just as is shown in FIG. 21.11, the hole 274 is placed in alignment with a hole 275 in the side wall 246 and a male fastener is inserted through the aligned holes from one side, and a female fastener is inserted into the aligned holes from the opposite side, and threads in the male fastener are mated with threads on the female fastener to releasably, and hingedly attach the graphics extension panel to the rectangular sleeve. A bottom tab 278 extends from a bottom end 279 of the front panel. To erect the panel extension 226, the side panels 272 are folded along fold lines 280 to be orthogonal to the front panel 270 and the bottom tab 278 is folded along fold line 279 180°, and an outer planar surface of the tab is attached to an inner planar surface of the front panel 270 by an adhesive. The graphics extension panel 226 has a front panel 270 flanked by two side panels 272 opposed to one another. A hole 274 is provided on each of the two side panels 272 proximate a top end. The adjust-a-lok fastener in FIG. 7 is placed in the hole to attach the graphic extension panel to the rectangular sleeve.

The display 200 can also incorporate a shelf 64 as described above.

Figure 20:
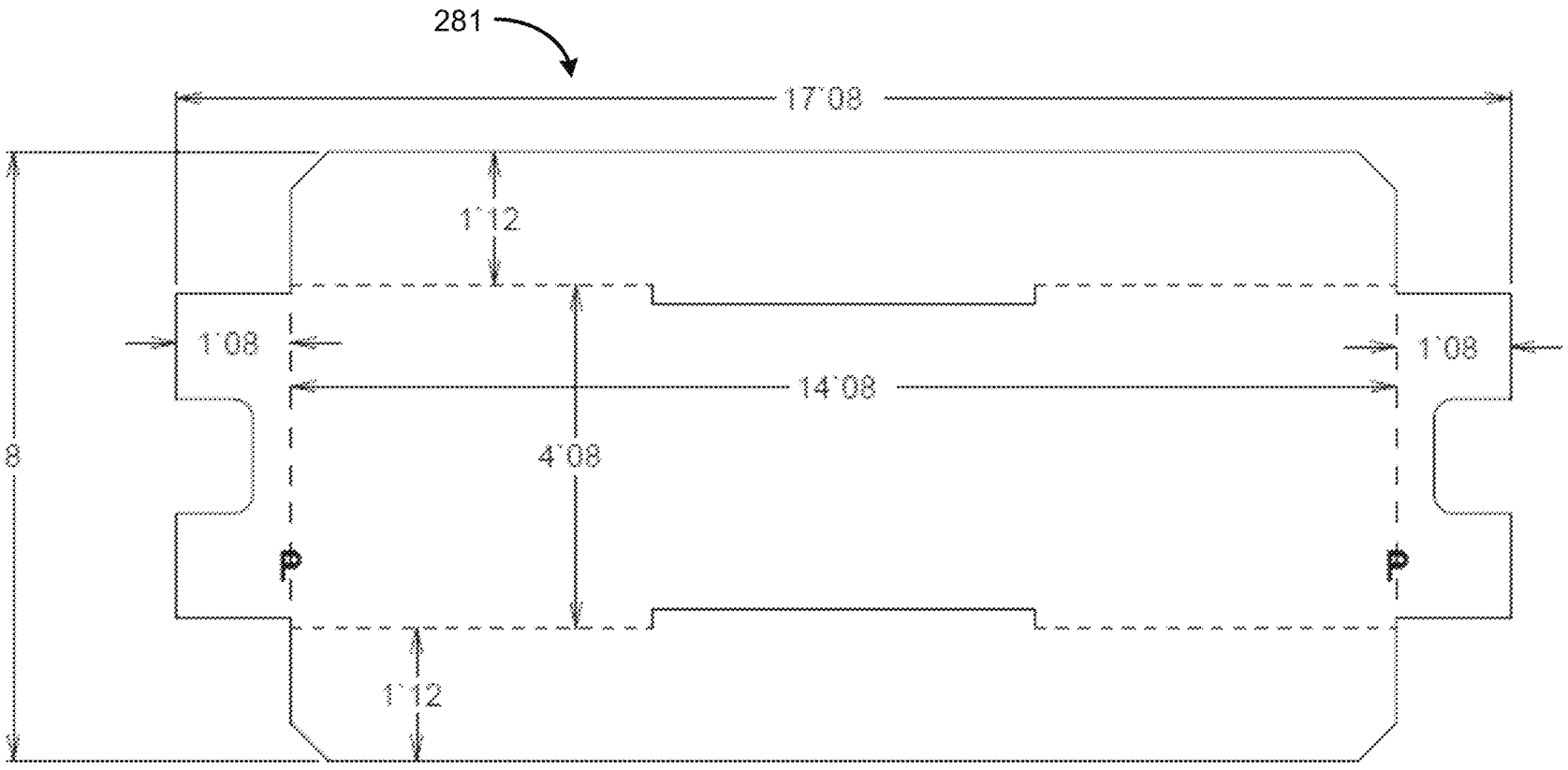
FIG. 20 is a plan view of a blank for forming a false bottom.
Figure 22:
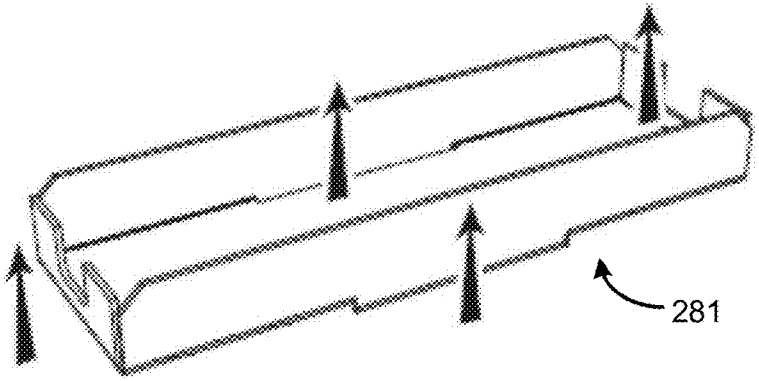
Figure 23:
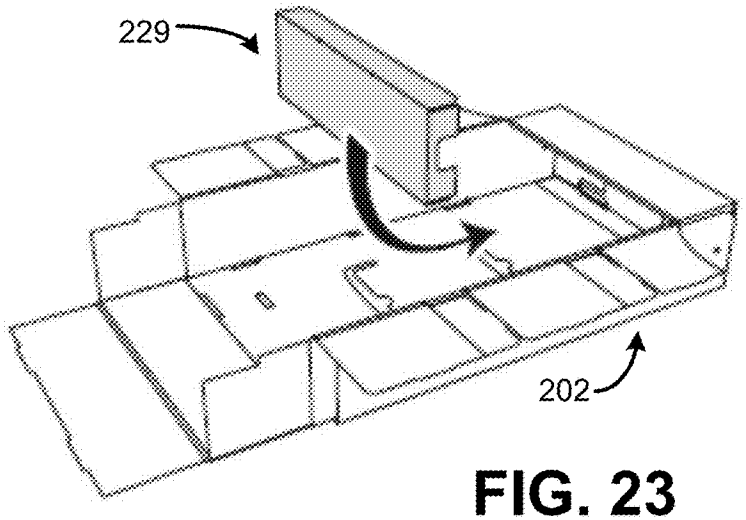

The display 200 can also incorporate a false bottom 229 folded from the blank 281 of FIG. 20 as shown in FIG. 22 and is incorporated into the display as shown in FIGS. 22-24 and is positioned in a top portion of an inner chamber with a planar surface facing downward to act as a ceiling of the rectangular chamber.

Figure 25:
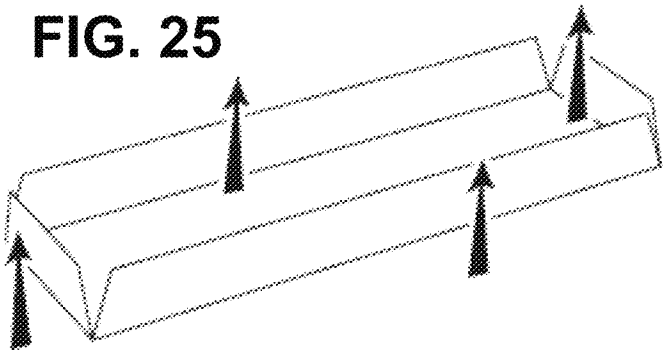
FIGS. 25-27 illustrate the steps of folding a riser and inserting it onto a shelf in the display.
Figure 26:
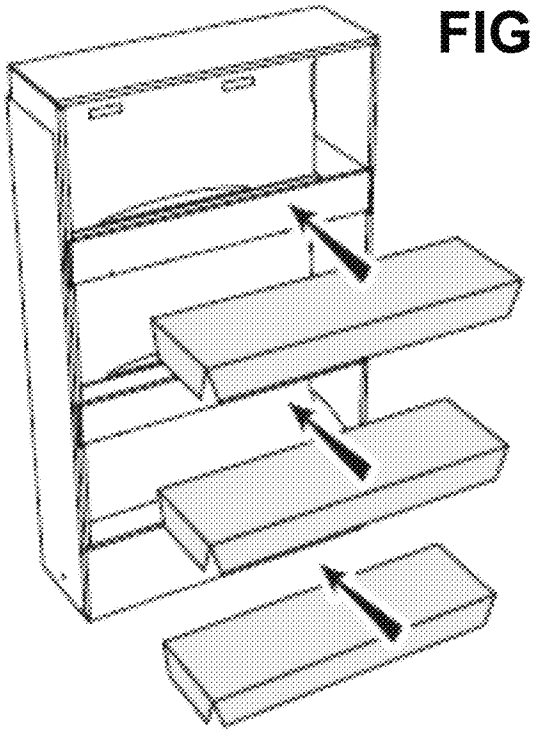
Figure 27:
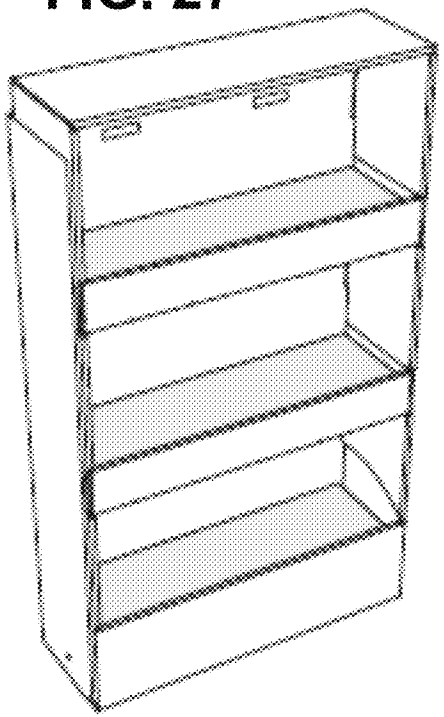

A riser is folded from a blank 292 and is incorporated into the display as shown in FIGS. 25-27.

Figure 28:
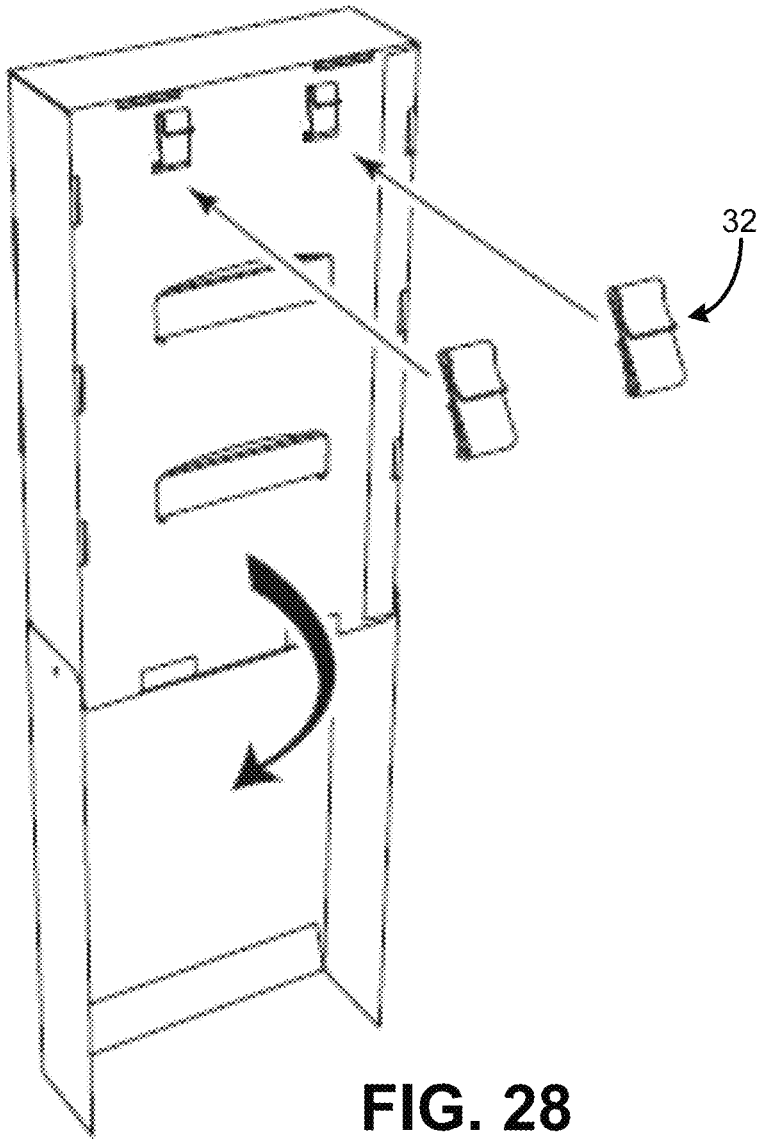
FIG. 28 shows a rear perspective view of a display utilizing a U-shaped clip for retaining blanks in a stowed condition.

FIG. 28 shows how U-shaped clips 32 inserted into the holes 232 and are used to hold the blanks for forming the drawers, risers, platforms during shipment.

The corrugated paper of the present invention can be corrugated paperboard, paper board, plastic sheeting, corrugated plastic material, and tri-laminate plastic material.

Many modifications and variations of the present invention are possible in light of the above teachings. It is, therefore, to be understood within the scope of the appended claims the invention may be protected otherwise than as specifically described.

We claim:

1. A corrugated paper display moveable from a stowed condition to a deployed condition comprising:

a first rectangular sleeve folded from a first blank of corrugated paper having a back wall panel, a front wall panel, a top surface panel, two opposed side wall panels each having a first lateral edge and a second lateral edge opposed to the first lateral edge, the first lateral edges being connected respectively to opposed lateral edges of the back wall, and each second lateral edge being connected to a segmented shelf support panel, each segmented shelf support panel has a pair of shelf support flaps separated by a gap, each shelf support flap of each segmented shelf support panel is folded downward to contact an inner surface of a respective side wall panel;

a shelf positioned in a respective gap of each segmented shelf support and being folded from a second blank of corrugated paper, the shelf being supported at opposed ends by one respective shelf support flap of each segmented shelf support respectively when the display is in the deployed condition;

a third panel folded from a third blank of corrugated material and having a front panel and two side panels extending from opposed lateral edges of the front panel and extending orthogonally therefrom, the third panel is rotatably connected to the first rectangular sleeve, wherein in the stowed condition a first planar surface of the front panel is in contact with a portion of the first rectangular sleeve, the first rectangular sleeve is nested within the third panel, and the display has a first height, and in the deployed condition the third panel is rotated to be underneath the first rectangular sleeve and the display has a second height which is 1.5 to 2.5 times greater than the first height;

a connector that attaches the third panel to the first rectangular sleeve to allow rotational movement from the stowed condition to the deployed condition.

2. The display of claim 1 further comprising a header panel extending from the top surface panel and being vertically oriented when the display is in the deployed condition.

3. The display of claim 1 wherein the back wall has a slot and a portion of the shelf extends through the slot.

4. The display of claim 1 further comprising a divider panel on the shelf to divide the shelf into sub-chambers, the divider panel being folded from a fourth blank of corrugated material.

5. The display of claim 4 wherein the divider panel has a cutout on a front edge to provide access to products on the shelf.

6. The display of claim 1 further comprising a platform on the shelf to form a surface vertically above a bottom wall of the shelf.

7. The display of claim 6 wherein the platform is folded from a fifth blank of corrugated material.

8. The display of claim 1 wherein the connector comprises a tab extending from one of the first rectangular sleeve or the third panel and a slot in the other of the first rectangular sleeve or the third panel and the tab is configured to be positioned in the slot.

9. The display of claim 1 wherein the connector comprises a two-part fastener inserted into aligned holes in the first rectangular sleeve and the third panel.

10. The display of claim 1 further comprising a bottom wall hingedly connected to the back wall and defining a bottom end of the first rectangular sleeve.

11. A corrugated paper display moveable from a stowed condition to a deployed condition comprising:

a first rectangular sleeve folded from a first blank of corrugated paper having a back wall panel, a front wall panel, a top surface panel, two opposed side wall panels each having a first lateral edge and a second lateral edge opposed to the first lateral edge, the first lateral edges being connected respectively to opposed lateral edges of the back wall, and each second lateral edge being connected to a segmented shelf support panel, each segmented shelf support panel has a pair of a shelf support flaps and gaps in vertical spaced relationship; wherein when the display is in the deployed condition, each shelf support flap of each segmented shelf support panel is folded downward to contact an inner surface of a respective side wall panel;

a first shelf positioned in one of the gaps of each segmented shelf support and being folded from a second blank of corrugated paper, the first shelf being supported at opposed ends by a first respective shelf support flap of each segmented shelf support respectively when the display is in the deployed condition;

a second shelf positioned in another one of the gaps of each segmented shelf support and being folded from a third blank of corrugated paper, the second shelf being supported at opposed ends by a second respective shelf support flap of each segmented shelf support respectively when the display is in the deployed condition;

a third panel folded from a fourth blank of corrugated material and having a front panel and two side panels extending from opposed lateral edges of the front panel and extending orthogonally therefrom, the third panel is rotatably connected to the first rectangular sleeve, wherein in the stowed condition a first planar surface of the front panel is in contact with a portion of the first rectangular sleeve, the first rectangular sleeve is nested within the third panel, and the display has a first height, and in the deployed condition the third panel is rotated to be underneath the first rectangular sleeve and the display has a second height which is 1.5 to 2.5 times greater than the first height;

a connector that attaches the third panel to the first rectangular sleeve to allow rotational movement from the stowed condition to the deployed condition.

12. The display of claim 11 further comprising a header panel extending from the top surface panel and being vertically oriented when the display is in the deployed condition.

13. The display of claim 11 wherein the back wall has a first slot and a second slot, wherein a portion of the first shelf extends through the first slot and a portion of the second shelf extends through the second slot.

14. The display of claim 11 further comprising a divider panel on the first shelf to divide the first shelf into sub-chambers, the divider panel being folded from a fifth blank of corrugated material.

15. The display of claim 14 wherein the divider panel has a cutout on a front edge to provide access to products on the first shelf.

16. The display of claim 11 further comprising a platform on the first shelf to form a surface vertically above a bottom wall of the first shelf.

17. The display of claim 16 wherein the platform is folded from a fifth blank of corrugated material.

18. The display of claim 11 wherein the connector comprises a tab extending from one of the first rectangular sleeve or the third panel and a slot in the other of the first rectangular sleeve or the third panel and the tab is configured to be positioned in the slot.

19. The display of claim 11 wherein the connector comprises a two-part fastener inserted into aligned holes in the first rectangular sleeve and the third panel.

20. The display of claim 11 further comprising a bottom wall hingedly connected to the back wall and defining a bottom end of the first rectangular sleeve.

* * * * *